US011180919B1

(12) United States Patent
Nelson, Jr.

(10) Patent No.: US 11,180,919 B1
(45) Date of Patent: Nov. 23, 2021

(54) METAL ROOF/WALL APPARATUS INCLUDING SLIDING CLIPS

(71) Applicant: G. Paul Nelson, Jr., Kenner, LA (US)

(72) Inventor: G. Paul Nelson, Jr., Kenner, LA (US)

( * ) Notice: Subject to any disclaimer, the term of this patent is extended or adjusted under 35 U.S.C. 154(b) by 0 days.

(21) Appl. No.: 16/351,920

(22) Filed: Mar. 13, 2019

Related U.S. Application Data

(60) Provisional application No. 62/703,980, filed on Jul. 27, 2018, provisional application No. 62/642,133, filed on Mar. 13, 2018.

(51) Int. Cl.

| | |
|---|---|
| ***E04D 1/30*** | (2006.01) |
| ***E04D 3/362*** | (2006.01) |
| ***E04D 3/30*** | (2006.01) |
| ***E04D 3/366*** | (2006.01) |
| *E04D 3/361* | (2006.01) |

(52) U.S. Cl.
CPC ..... *E04D 3/362* (2013.01); *E04D 1/30* (2013.01); *E04D 3/30* (2013.01); *E04D 3/366* (2013.01); *E04D 2003/3615* (2013.01)

(58) Field of Classification Search
CPC .. E04D 3/362; E04D 1/30; E04D 3/30; E04D 3/366; E04D 2003/3615
See application file for complete search history.

(56) References Cited

U.S. PATENT DOCUMENTS 318,352 A * 5/1885 Caldwell ..... E04D 3/366 52/466
1,612,075 A * 12/1926 Tapman, Jr. ..... E04D 3/3605 52/712
1,786,751 A * 12/1930 Heeren ..... E04D 13/1618 52/335

(Continued)

FOREIGN PATENT DOCUMENTS

DE 4422423 A1 * 4/1995
EP 64404 A * 11/1982

(Continued)

OTHER PUBLICATIONS

MasterRib_Installation brochure available at http://www.unioncorrugating.com/literature/MasterRib_Installation.pdf.

(Continued)

*Primary Examiner* — Brian D Mattei
*Assistant Examiner* — Charissa Ahmad
(74) *Attorney, Agent, or Firm* — Garvey, Smith & Nehrbass, Patent Attorneys, L.L.C.; Charles C. Garvey, Jr.; Mackenzie D. Rodriguez

(57) ABSTRACT

A metal roof construction provides a roof frame that includes multiple rafters. A plurality of clips or anchor plates are fastened to each rafter. Each anchor plate or clip has an anchor plate space surrounded by one or more plate members. The anchor plate has a plurality of spaced apart openings. A sliding anchor occupies the anchor plate space. Each sliding anchor has multiple spaced apart pedestals that extend from the anchor plate space upwardly through an opening. Multiple roof decking sections are mounted on the rafters. Each decking section extends under a part of the anchor plate. The anchor plate has one or more flaps that extend downwardly from the decking sections and next to a rafter. Fasteners attach each flap to a rafter.

11 Claims, 45 Drawing Sheets

(56) References Cited

U.S. PATENT DOCUMENTS 1,810,287 A * 6/1931 Mahon ..... E04D 3/362 52/714
2,007,354 A * 7/1935 Vass ..... E04B 5/10 52/588.1
2,282,631 A * 5/1942 Ross ..... E04B 2/58 411/516
2,426,237 A * 8/1947 Pfeifer, Jr. ..... E04D 3/3607 52/464
3,031,044 A * 4/1962 Stitt ..... E04B 1/94 52/508
3,423,892 A 1/1969 Rimington
3,852,929 A * 12/1974 Cookson ..... F16B 5/125 52/543
3,982,373 A * 9/1976 Wilson ..... E04D 3/30 52/90.1
3,998,019 A * 12/1976 Reinwall, Jr. ..... E04D 3/362 52/478
4,102,105 A * 7/1978 Taylor ..... E04D 3/30 52/394
4,184,299 A * 1/1980 East ..... E04D 3/361 52/463
4,193,247 A * 3/1980 Heckelsberg ..... E04D 3/361 52/713
4,226,070 A * 10/1980 Aragon ..... E04D 1/265 52/57
4,266,384 A * 5/1981 Orals ..... E04B 9/22 52/407.1
4,269,012 A 5/1981 Mattingly et al.
4,296,581 A * 10/1981 Heckelsberg ..... E04D 3/362 52/520
4,329,823 A * 5/1982 Simpson ..... E04C 3/08 403/161
4,348,846 A * 9/1982 Bellem ..... E04D 3/362 52/410
4,361,998 A * 12/1982 Ellison ..... E04D 3/363 52/463
4,435,926 A 3/1984 Struben
4,435,937 A * 3/1984 Stone ..... E04D 3/3602 52/520
4,514,952 A * 5/1985 Johansson ..... E04D 3/362 52/520
4,522,005 A * 6/1985 Seaburg ..... E04D 3/362 52/520
4,570,404 A * 2/1986 Knudson ..... E04D 3/364 52/394
4,594,823 A * 6/1986 Hague ..... E04D 3/3607 403/306
4,649,684 A 3/1987 Petree et al.
4,676,042 A * 6/1987 Bell, III ..... E04D 3/3602 52/478
5,001,881 A 3/1991 Boyd
5,001,882 A * 3/1991 Watkins ..... E04D 3/362 52/478
5,222,341 A 6/1993 Watkins et al.
5,606,838 A * 3/1997 Hughes ..... E04D 3/362 52/520
5,636,488 A 6/1997 Lawrence et al.
5,743,063 A * 4/1998 Boozer ..... E04B 7/00 52/508
6,354,045 B1 3/2002 Boone et al.
6,415,581 B1 * 7/2002 Shipman ..... E04B 5/40 428/593
6,715,256 B1 4/2004 Fischer
7,707,791 B2 5/2010 Peleg
7,963,083 B1 * 6/2011 Briggs ..... E04D 3/364 52/520
8,091,312 B2 * 1/2012 Simpson ..... E04D 3/364 52/520
8,505,261 B2 * 8/2013 McClure ..... E04D 3/366 52/713
9,580,909 B2 * 2/2017 Hostetler ..... E04D 13/1618
9,834,934 B1 * 12/2017 Hodges, Jr. ..... E04D 3/364
9,995,041 B2 * 6/2018 Shoham ..... E04D 3/365
10,087,633 B2 * 10/2018 Kralic ..... E04D 1/36
10,385,571 B2 * 8/2019 Babcock ..... E04D 3/362
10,428,517 B1 * 10/2019 Starks, Jr. ..... E04D 13/158
10,640,980 B2 * 5/2020 Haddock ..... E04D 3/362
2003/0145548 A1 * 8/2003 Mitchell ..... E04D 3/3602 52/536
2005/0193644 A1 * 9/2005 Simpson ..... E04D 3/364 52/91.3
2006/0174571 A1 * 8/2006 Panasik ..... E04D 3/361 52/478

FOREIGN PATENT DOCUMENTS

EP 1098047 A1 * 5/2001
JP 1113195 1/1999
JP 2014101694 A * 6/2014

OTHER PUBLICATIONS

MasterRib_SellSheet available at http://www.unioncorrugating.com/literature/MasterRib_SellSheet.pdf.
YouTube link: https://www.youtube.com/watch?v=VCallPI-rvM.
Information about a panel and mounting bracket: http://www.stramit.com/au/sites/default/files/download-file/stramit_speed_deck_ultra_concealed_fixed_decking_product_technical_manual_0.pdf.

* cited by examiner

METAL ROOF/WALL APPARATUS INCLUDING SLIDING CLIPS

CROSS-REFERENCE TO RELATED APPLICATIONS

This application claims priority of my U.S. Provisional Patent Application Ser. No. 62/642,133, filed 13 Mar. 2018, and my U.S. Provisional Patent Application Ser. No. 62/703,980, filed 27 Jul. 2018, both of which are hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a roofing and/or wall system employing wrap-around roof/wall clips, support grid, roofing/wall panels and flashing clips. The present invention provides a specially configured clip apparatus that will allow movement in the roof panels in a 360-degree radius while achieving superior attachment strength when compared to standard roof clips. Mechanical attachments are based on utilizing the stronger properties of shearing verses pullout. The present invention allows roof and walls to achieve a 300 mph wind resistance while achieving 1,000+ psi on mechanical attachment. The present invention also allows much heavier gauge roof panels be used in roofing applications without exerting destructive thermal movement against support members.

2. General Background of the Invention

Metal roof and wall panels fall into one of two categories, structural or nonstructural. Structural panels are able to support live loads while spanning up to 6 feet across structural members. These types of panels need no decking beneath them. These panels are typically installed over structural members such as Z and C purlins or girts and wood or steel web joists. Nonstructural or what is sometimes referred to as Architectural panels cannot support live loads without a structural wood or metal deck being beneath them. Most residential roofs are treated as nonstructural panels. R-panels and some types of standing seam panels are structural panels. Many types of standing seam panels are nonstructural panels.

Currently, R-panels are fastened with screws through the panel itself and directly into the structural member. These screws are typically located in the water zone, which is in the low areas of the panels. This type of attachment also does not allow for thermal movement of the panels, thus forcing the screws to cut or groove the surrounding metal against the screw shank. If this slotting of the panel becomes severe enough to exceed the circumference of the screw sealing washer, water will leak into the building. Due to thermal movement, R-panel lengths are limited to 40 feet. Screws attached through the R-panel and into the structural member can achieve a maximum of two hundred twenty (220) psi of resistance to wind uplift, but the panel itself cannot normally withstand such point loads without tearing from around the screws. A 220-psi attachment would allow for a 125-185 mph wind rating depending on building height, surrounding obstacles and wind zone area.

Many standing seam roof panels are formed on the job site. Each roof panel formed onsite runs the full length from the ridge to the eave of the roof system. It is thus important that these roof panels be able to slide up and down as expansion and contraction can cause a good deal of movement. Typical steel panels can expand over ¾" per 100 linear foot and per 100 degrees Fahrenheit change. Normal roof clips used on standing seam roof panels accommodate thermal expansion/contraction in the direction of the length of the roof panel. Normal roof clips do not allow for unimpeded expansion and contractions in any direction other than the length of the roof panel.

The thickness of metal used in metal roofing and wall panels is currently limited to 22-gauge sheet metal. Most metal panels used are 26 and 24 gauge. To achieve wind ratings up to 185 mph, many manufacturers use 22-gauge metal. If heavier gauge metal was used to achieve higher wind ratings and the current methods of attachment were used, the panels would exert repeated overstresses to the building's substructure possibly causing catastrophic failure of the building supports.

The design of the present invention can be used with R-panels to keep the screws in the upper portion of the panel ribs and out of the lower areas of the panel where water flows. By attaching the R-panel to the grid system of the present invention via screws through the upper portion of the panel ribs, the present invention eliminates the leaking by slotting of the panel because the screws move with the panel and the grid system. The design of the present invention also increases the wind uplift resistance of the R-panel to over 300 mph.

The design of the present invention also allows for R-panels to be run in one long run equal to the distance from the eave to the ridge. Currently, the only types of panel that can be used in this way are standing seam panels combined with current roof clips that allow for expansion in the longitudinal direction. The clip design of the present invention can also be used with standing seam panels by forming the sliding anchor with a panel interface similar to current clip interfaces. The clip, when used with a standing seam panel, would give higher wind uplifting values than the ordinary standing seam clip.

The design of the present invention also allows metal panels of much thicker gauges to be used to not only increase the wind rating to a level greater than any level of storm can generate, but to also withstand impacts from wind born debris. The invention allows the roof/wall panels to expand and contract in any direction without exerting any of the pressures from the movement to the building infrastructure.

The present invention can be utilized for both structural and nonstructural applications by slightly changing the shape of the anchor plate. These changes are based on the shape of the structural member that the anchor plate is being attached to and the utilization of shearing forces over pullout.

3. General Discussion of the Present Invention

The wrap-around clip of FIGS. 1-45 allows movement in the roof grid system in a 360-degree radius while achieving superior attachment strength to standard roof clips. Current clips on the market mount on top of the flange of structural metal supports by the use of screws mounting the base of the clip to the top surface of the flange. The new clip design of the present invention can be installed on any style or size of structural member including Z-purlins, C-purlins, wood or steel web joists, wood rafters and/or wood decking with shear resistance being the common factor among all mechanical fasteners instead of pull-out resistance. These screws or fasteners tie the clip to the structural member in such a way that shearing forces would be required to dislodge the clip instead of pullout forces associated with current clip designs. Shearing forces of metal are far greater than screw pull out with shearing being normally about five (5) times greater than pullout forces.

The grid and roof/wall panels would also preferably be fastened based in such a way to utilize shear forces instead of pullout. When thicker gauge metal is used for the anchor plate, sliding anchor, grid members, panels and a stronger screw metallurgy, then the shearing resistance can be over 10 times greater than pull-out resistance of screws.

The clip design of the present invention is preferably made up of an anchor plate, sliding anchor, mounting grid, and panel. When a flashing clip is used with the roof system, the entire roof system becomes wind rated according to the metallurgy used.

Tandem™ and Tandem300™ are trademarks of TANDEM ROOFING PRODUCTS, LLC, a Louisiana limited liability company, 5000 W. ESPLANADE AVE., #424, METAIRIE, La.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

The function of each part is preferably as follows:

The Anchor Plate

Figure 9:
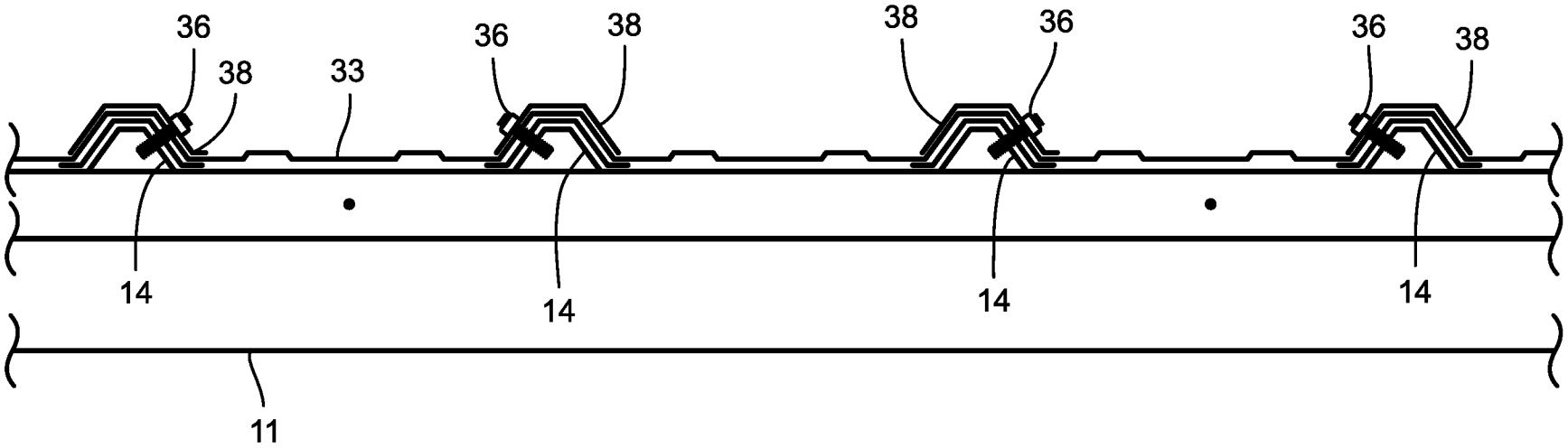
FIG. 9 is a sectional view of a preferred embodiment of the apparatus of the present invention showing a roof with R-panel roof panels.

The anchor plate houses the sliding anchor (FIGS. 1,7, 12,21). The sliding anchor is the mechanism that attaches a roof or wall panel to the structural member through the anchor plate. When anchor plates are installed on a member, they are preferably installed abutting each other (FIG. 9). This eliminates the repeated having to pop chalk lines to make sure each anchor point is properly aligned with other anchor points up and down slope of the roof system.

Figure 10:
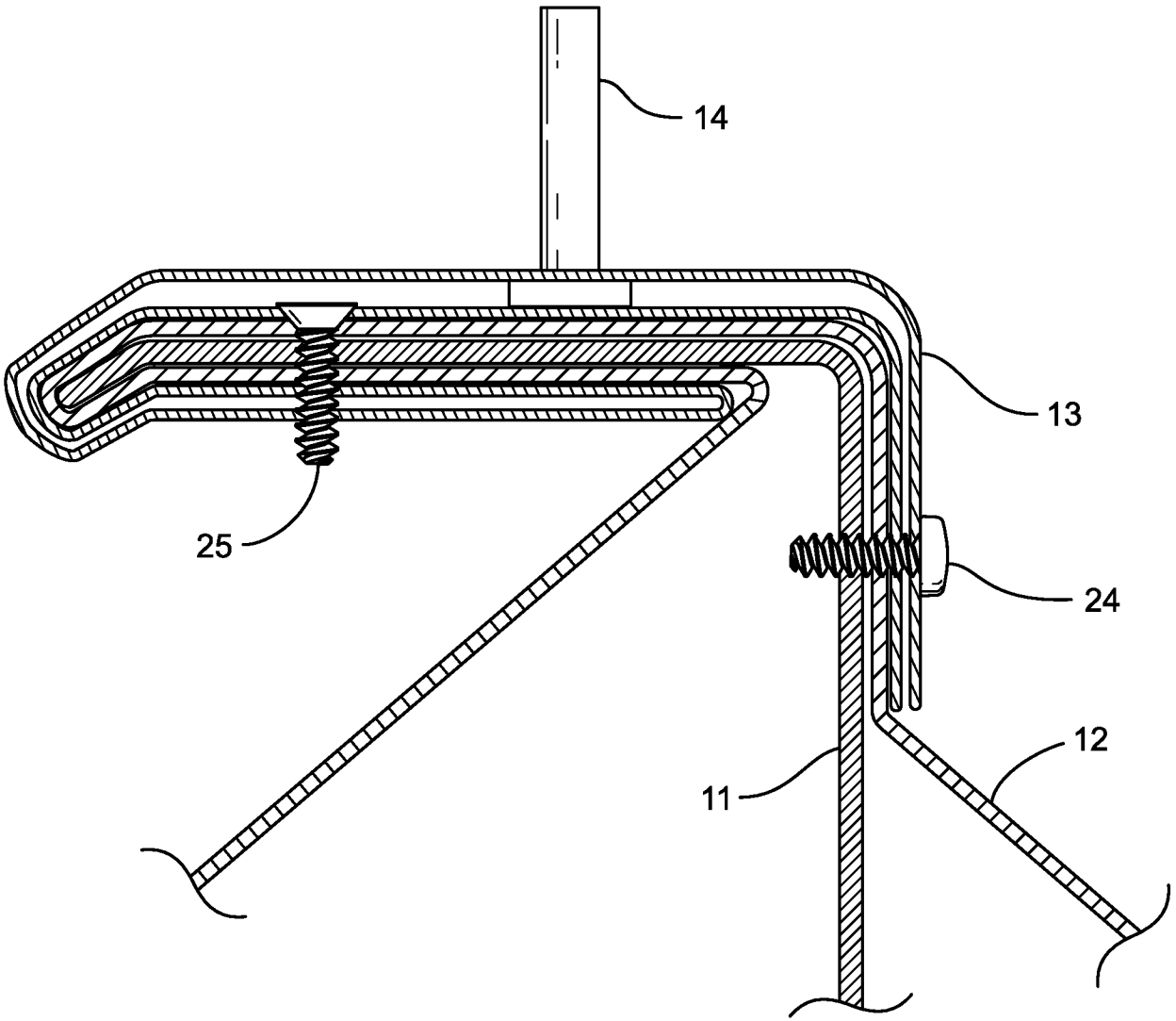
FIG. 10 is a sectional view of a preferred embodiment of the apparatus of the present invention showing an anchor body, sliding anchor and radiant barrier installed over a Z-purlin (structural application)
Figure 11:
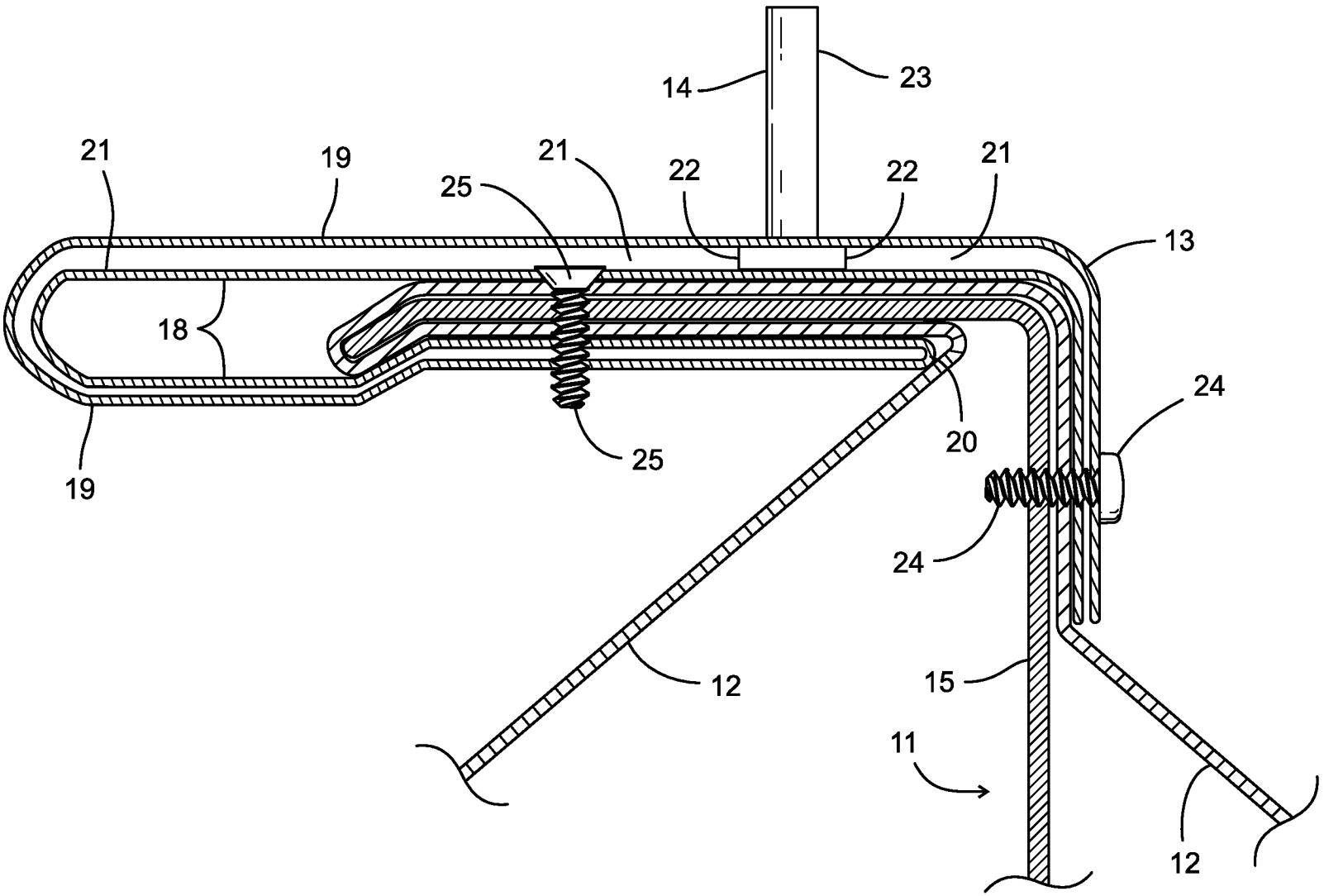
FIG. 11 is a sectional view of a preferred embodiment of the apparatus of the present invention showing an extended anchor body, sliding anchor and radiant barrier installed over a Z-purlin (structural application)
Figure 12:
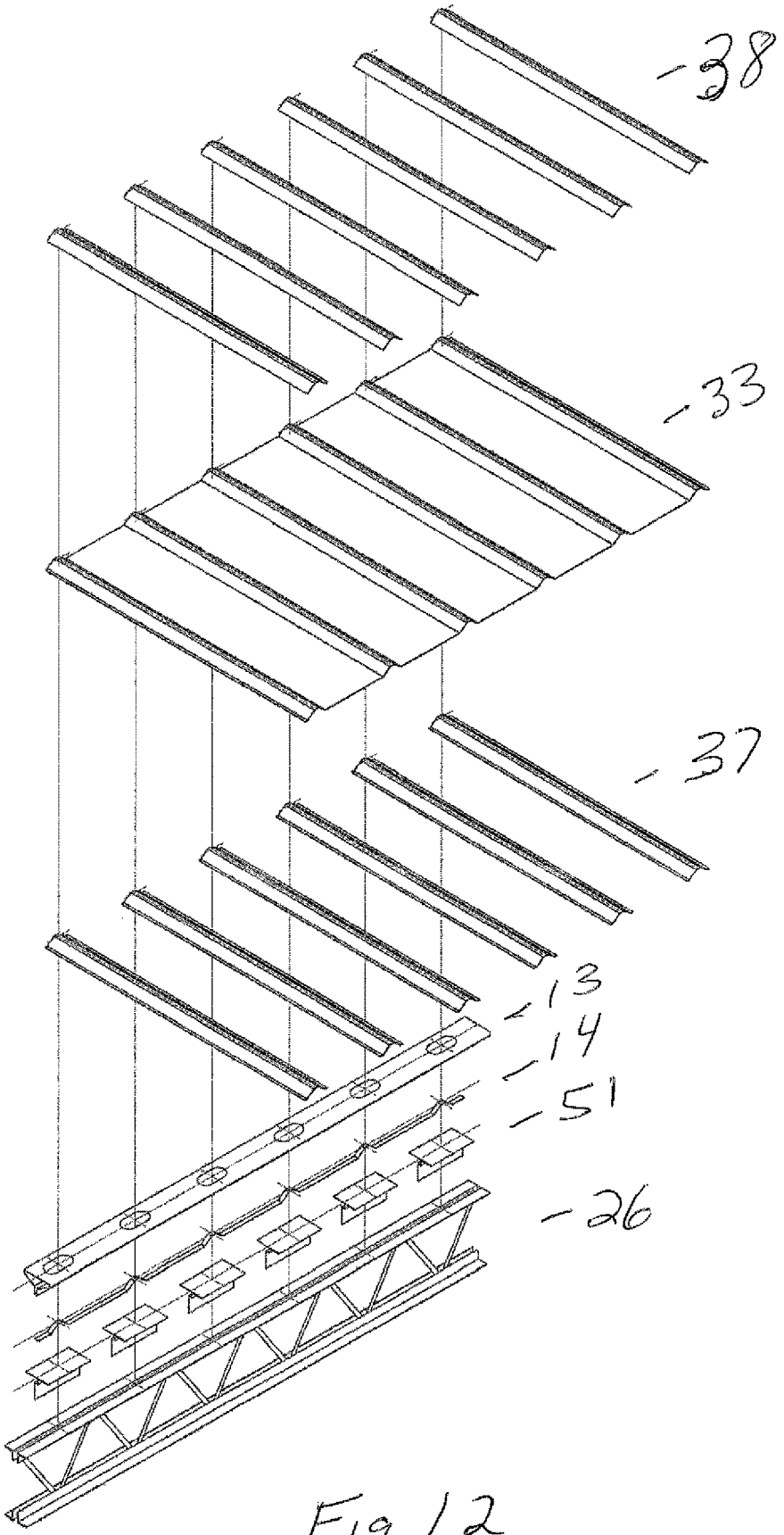
FIG. 12 is an exploded view of a preferred embodiment of the apparatus of the present invention showing the different components for web joist application (structural)

The anchor plate can be made of one piece of metal shaped to wrap around the top flange of the structural member (FIGS. 8,10,11,13,16,20,22,28,29). However, the anchor plate can also be made of several pieces of metal plate with each plate being made of the same thickness and type of metal or different thicknesses and types of metal. The anchor plate can be any length or width to allow an increase in number of sliding anchor points or an increase in thermal expansion allowance. However, it is anticipated that the normal anchor plate for a Z or C purlin application will preferably be about six (6) feet long (running along the length of the purlin) and about three inches (3") across the top flange of the purlin. The anchor plate is preferably not limited to the surface area of the top flange width, but can extend beyond the end of the top flange to allow for a longer movement of the sliding anchor (FIG. 11).

The anchor plate preferably has two different sets of screws to help hold it in place. The vertical anchor plate screws (FIG. 10, #24) and the horizontal anchor plate screws (FIG. 10, #25) provide a shearing resistance to any force exerted to the anchor plate by upward forces exerted on the sliding anchor (FIG. 10, #14). With normal roof clips, the resistant to upward force is accomplished by the pull-out resistance provided by screw threads. Pull-out forces for most screws used with ordinary roof clips are approximately 220 pounds per square inch. Shearing resistance of the designed clip is more than 5 times this amount while using the same type of screws. When thicker gauge metal is used for the anchor plate, sliding anchor, and a stronger screw metallurgy, then the shearing resistance can be over ten (10) times greater than pull-out resistance of screws.

Figure 3:
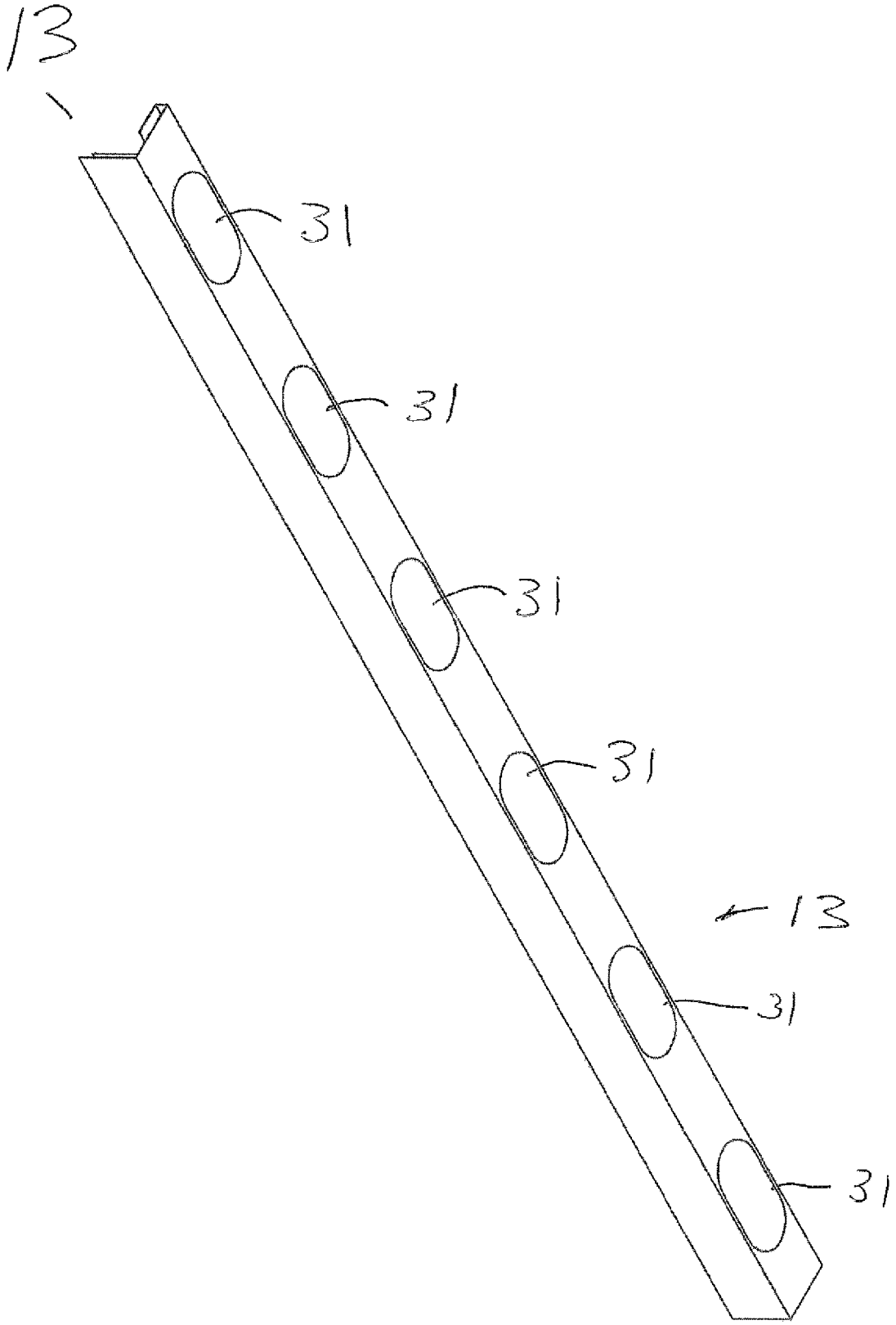
FIG. 3 is an isometric view of the anchor plate of a preferred embodiment of the apparatus of the present invention used in Z-purlin structural applications.

Preferably, the sliding anchors are received in large enough openings in the anchor plate (FIG. 3, #31) that they can move in any direction. Preferably, the anchor plate and openings allow for anything from no movement to up to 12 inches on some projects (and even more if required). Typically, the clips and openings allow for up to about 1.5 inches per 100 feet of roof length. However, the sliding anchor openings in the anchor plate can be configured in any size of shape depending on roof application.

Figure 13:
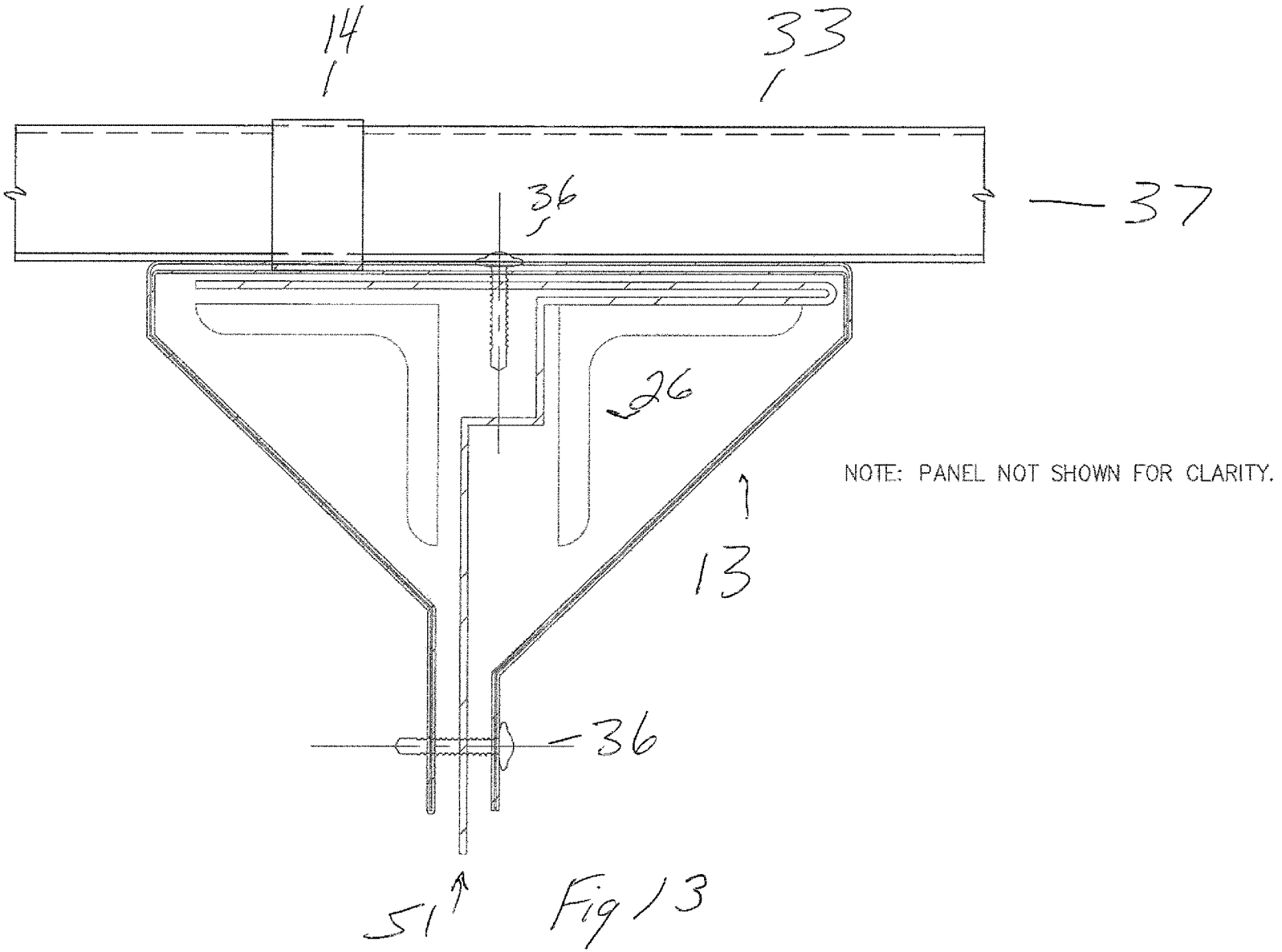
FIG. 13 is a sectional view of a preferred embodiment of the apparatus of the present invention showing an anchor body, sliding anchor, web joist insert, and bottom cleat installed over a web joist (structural application)
Figure 14:
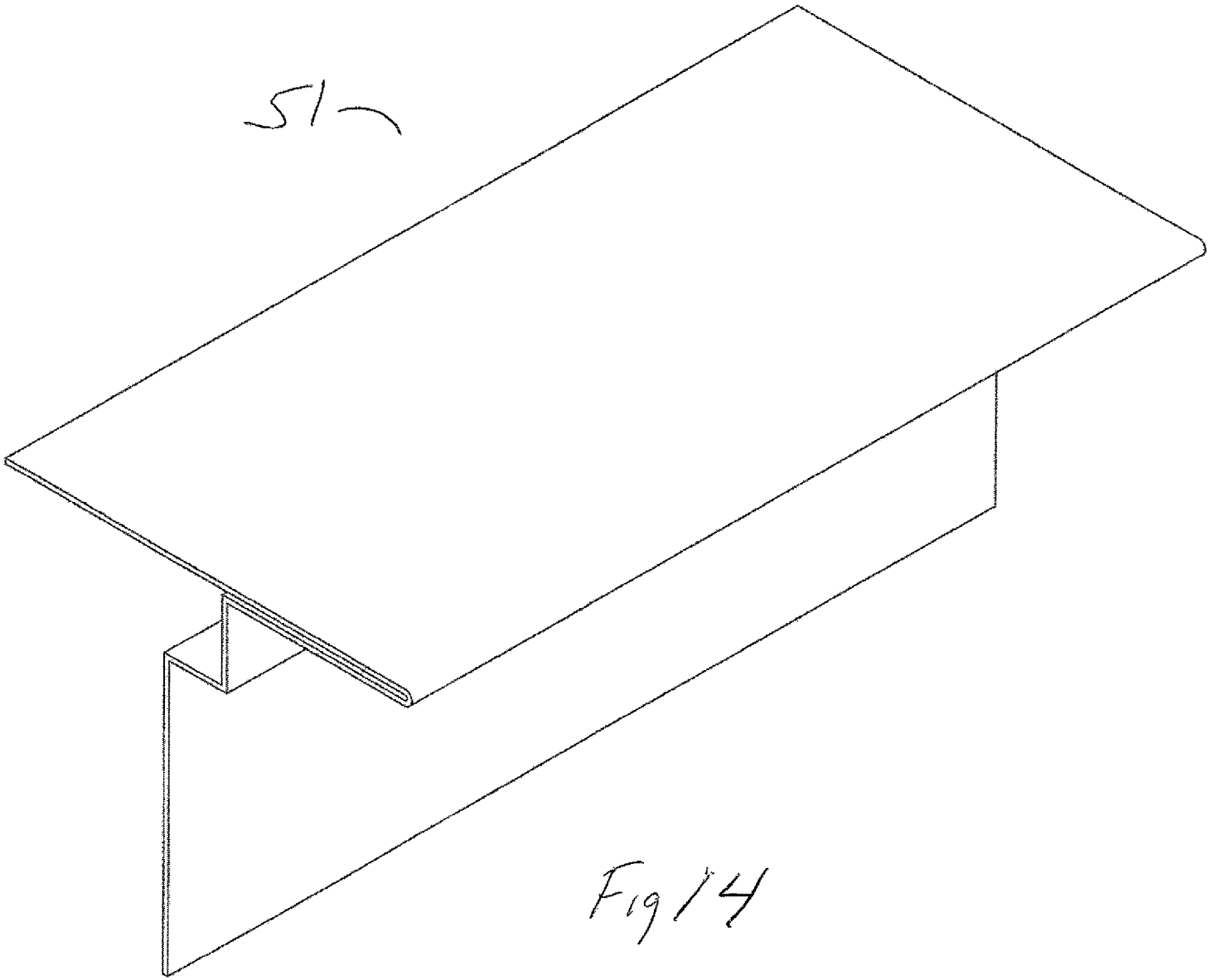
FIG. 14 is an isometric view of the web joist insert of a preferred embodiment of the apparatus of the present invention used in web joist structural applications.
Figure 15:
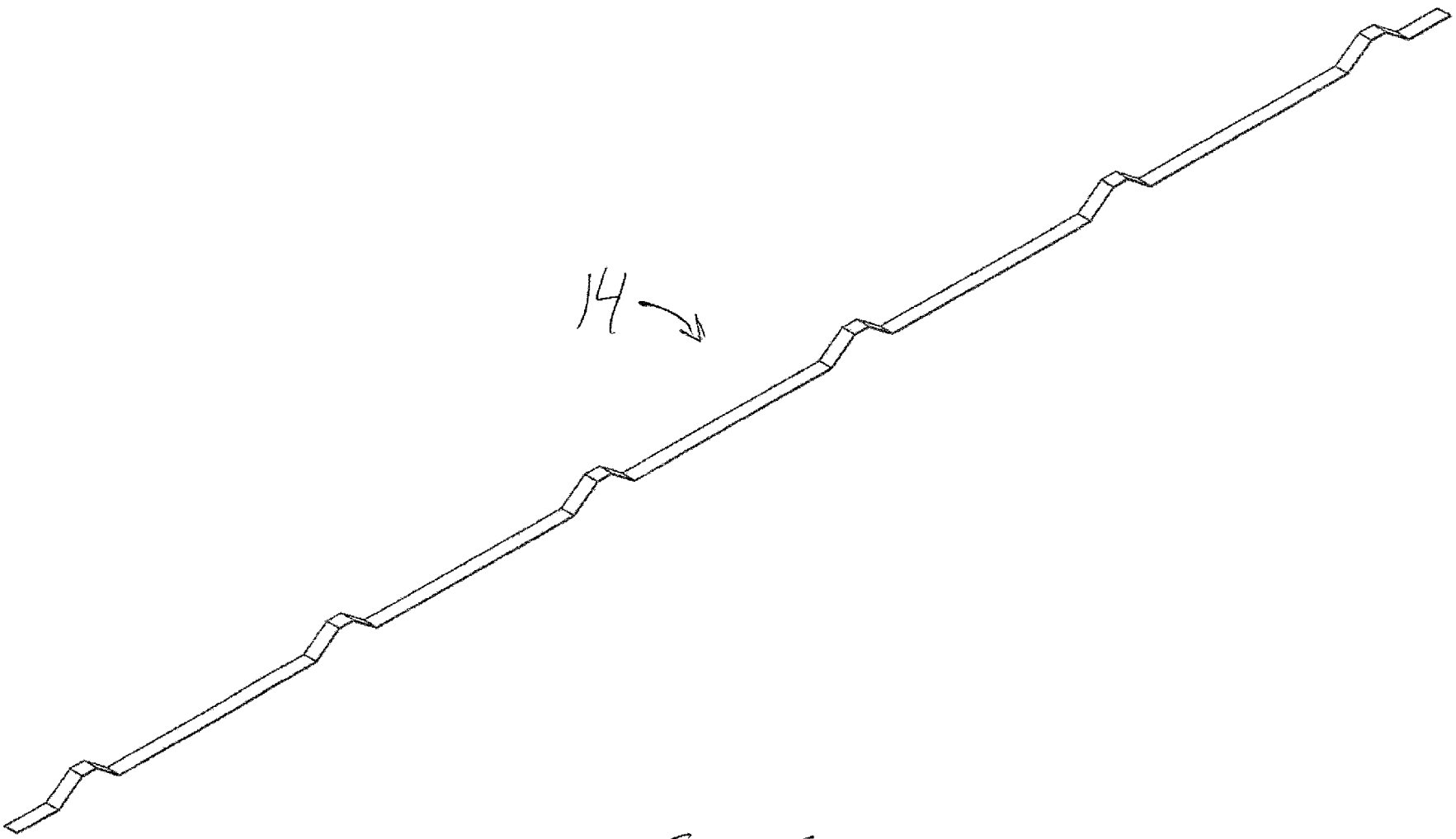
FIG. 15 is an isometric view of the sliding anchor of a preferred embodiment of the apparatus of the present invention used in structural applications (as installed with R-panels profiles)
Figure 16:
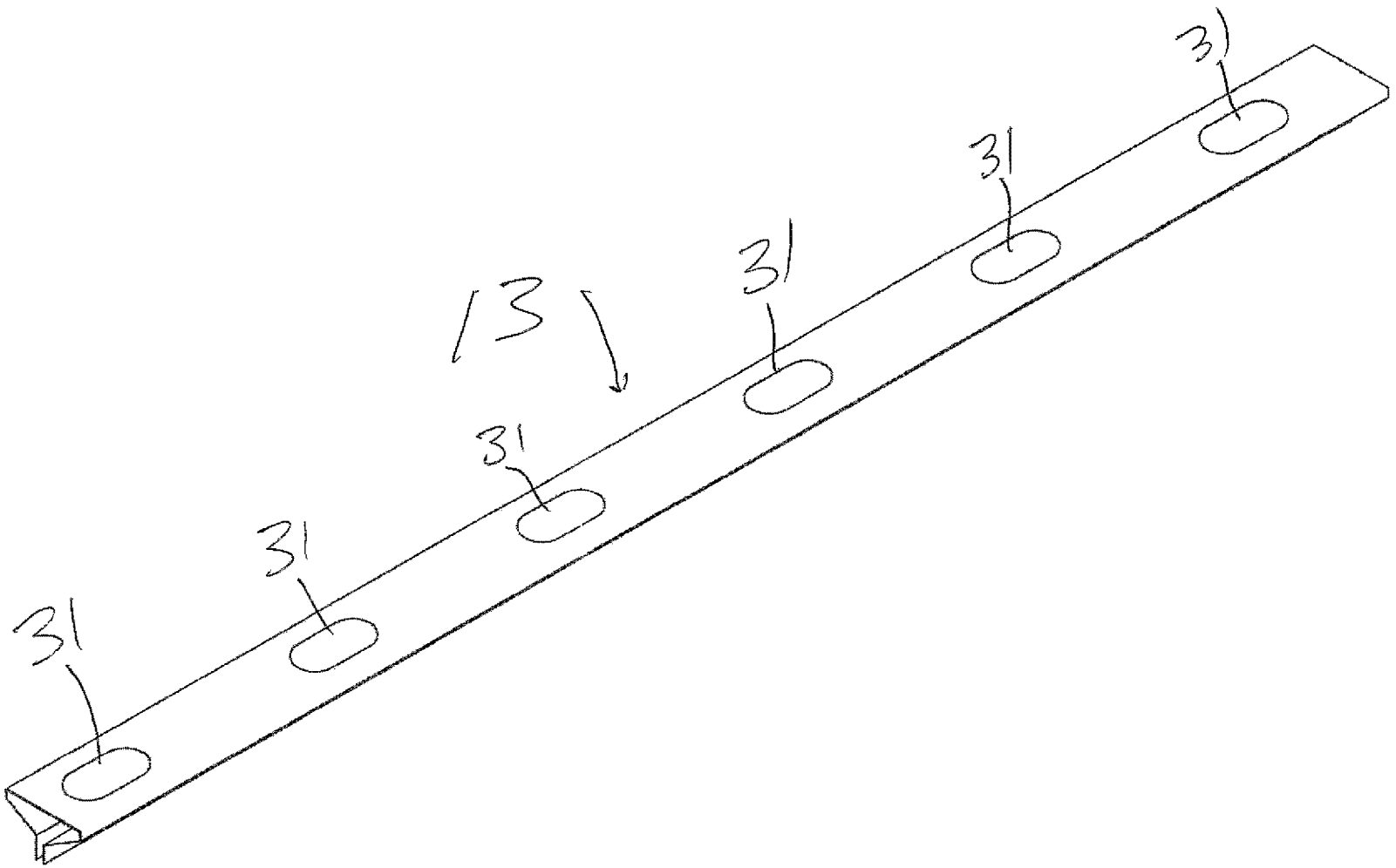
FIG. 16 is an isometric view of the anchor plate of a preferred embodiment of the apparatus of the present invention used in web joist structural applications.

Preferably, for web joist applications (FIG. 12, #26), the anchor plate will be about six (6) feet long (running along the length of the web joist) and about three inches (3") across the top flange of the joist (FIG. 13, #13). The anchor plate is not limited to the surface area of the top flange width, but can extend beyond the end of the top flange to allow for a longer movement of the sliding anchor. A web joist insert (FIG. 14) can be installed in the web joist webbing (FIG. 13, #51) to assure the two wings of the anchor plate easily achieve shearing attachment.

Figure 24:
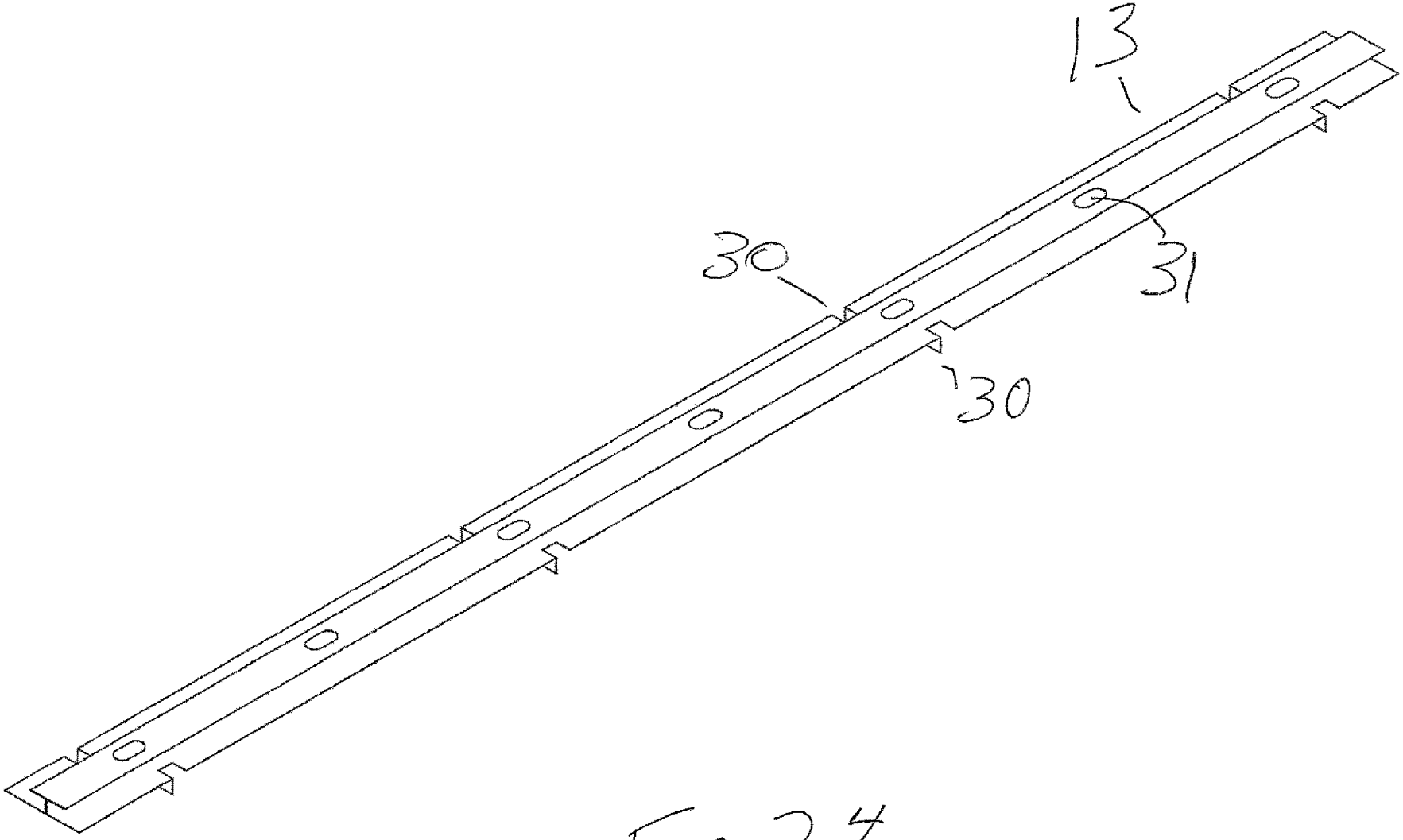
FIG. 24 is an isometric view of the anchor plate of a preferred embodiment of the apparatus of the present invention used in architectural/nonstructural applications.
Figure 27:
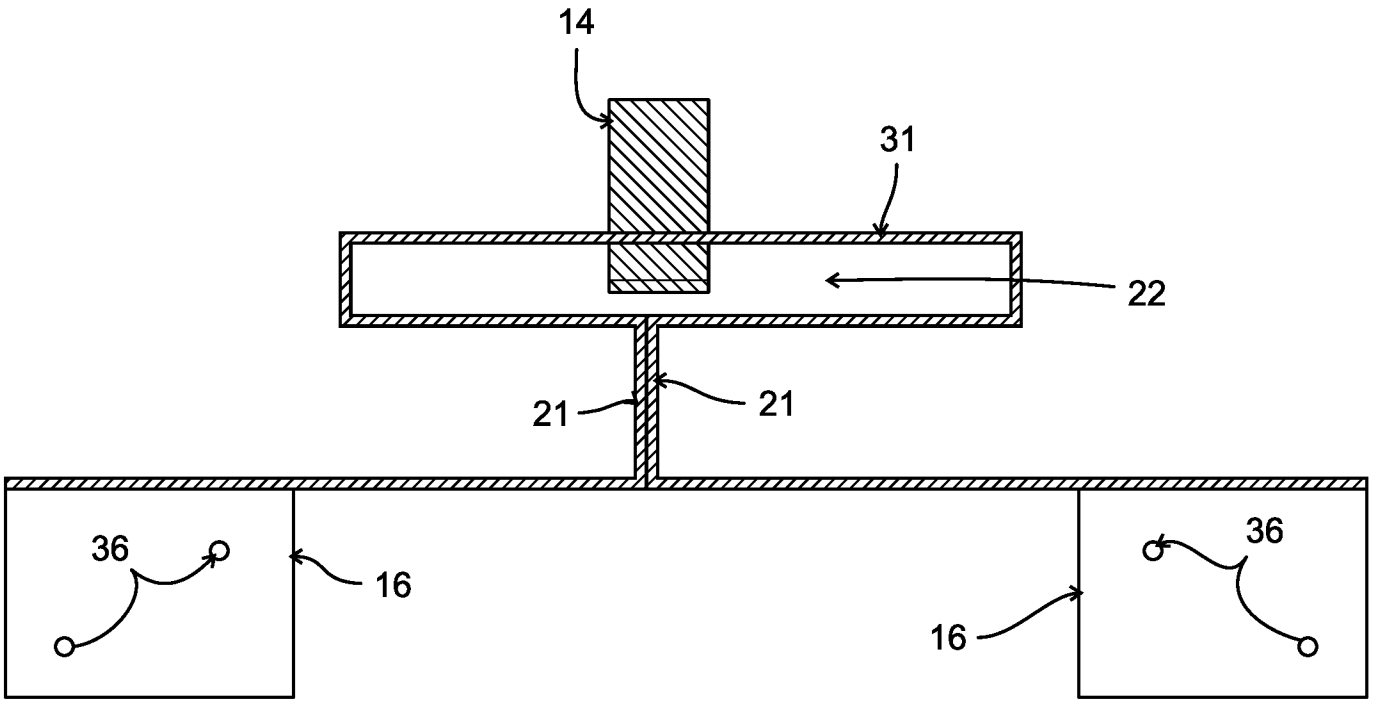
FIG. 27 is a sectional view of a preferred embodiment of the apparatus of the present invention showing an anchor body and sliding anchor while showing the hurricane anchor section of the anchor body for nonstructural applications (not installed)
Figure 28:
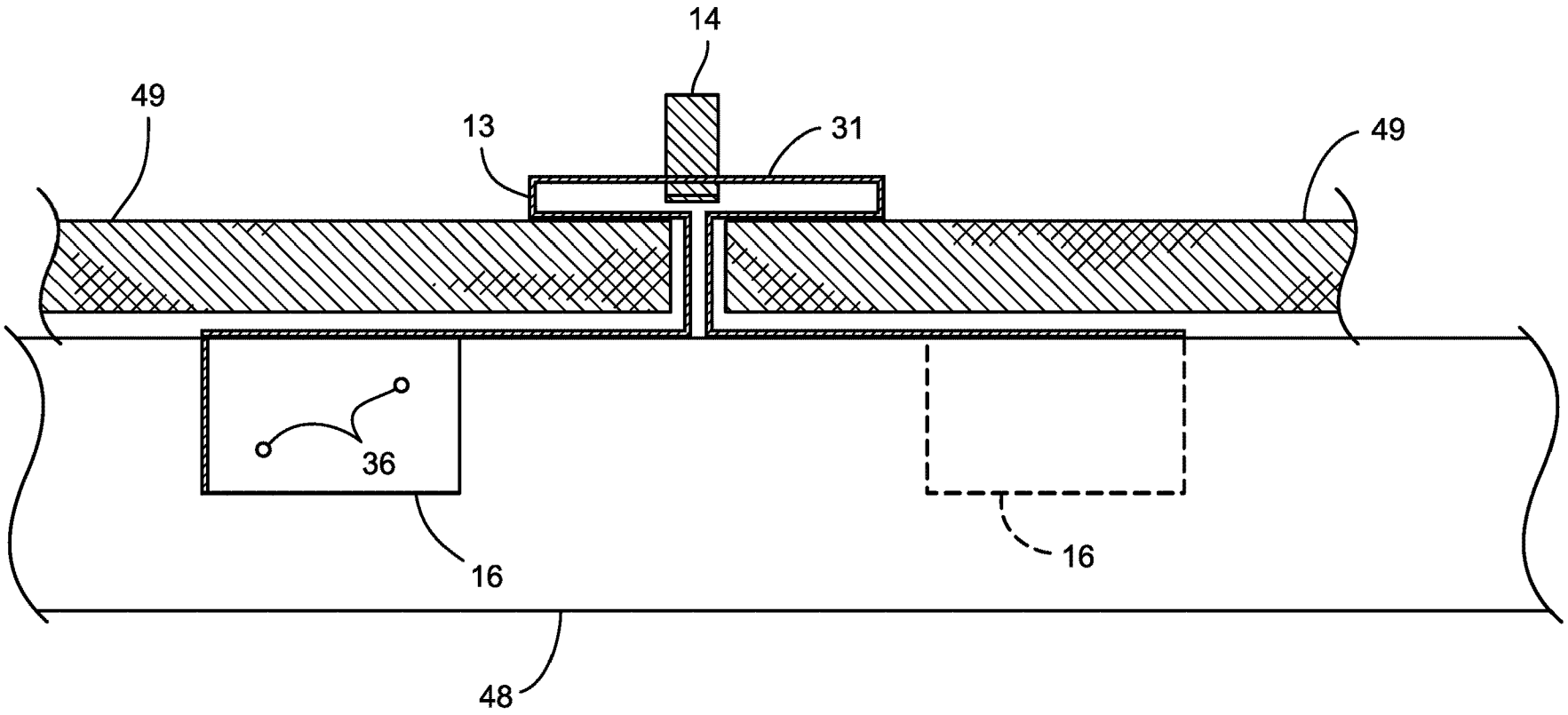
FIG. 28 is a sectional view of a preferred embodiment of the apparatus of the present invention showing an anchor body and sliding anchor installed over a decking and rafter system (nonstructural application)

Preferably, on residential and nonstructural applications, the anchor plate has bendable flaps on both sides of the base of the anchor plate (FIG. 24, #30 & FIG. 27, #16). These flaps are preferably offset to each other so that when the anchor plate is installed on top of the roof rafters, the flaps are on opposite sides of the same rafter. When screws or nails are put into the flaps and through the rafter, the bendable portion of the anchor plate becomes a hurricane strap (FIG. 28, #16). This feature allows each anchor plate to be directly fastened to a hurricane strapped structural member. The hurricane anchor plate also provides hurricane strapping of the roof deck. To the knowledge of the present inventor, no other product on the market allows the roof deck, clips or roof panels to be hurricane strapped to the structural members.

Figure 20:
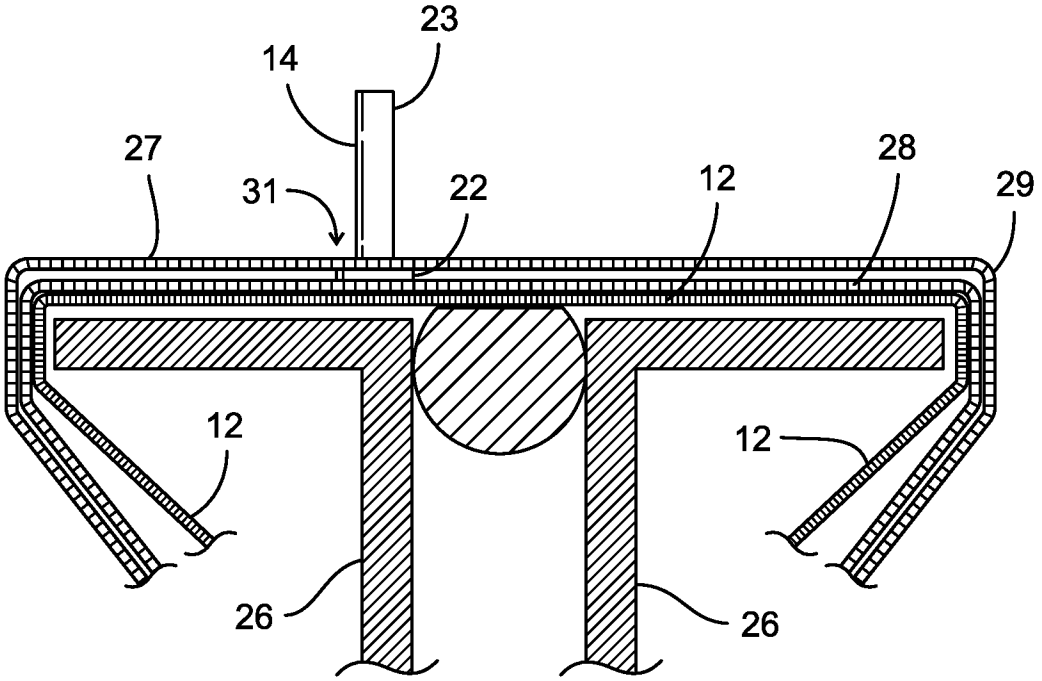
FIG. 20 is a sectional view of a preferred embodiment of the apparatus of the present invention showing an anchor body, sliding anchor and radiant barrier (web joist insert not shown) installed over a web joist (structural application)

If insulation is added to a new roof install, the clip design of the present invention preferably wraps the insulation around the top flange of the structural member (FIGS. 10 & 20, #12). This design significantly cuts down on labor time for the installation of insulation by reducing the need for double-sided tape to hold insulation in place and trying to set a uniform drape in the insulation (FIG. 11, #12). The anchor plate holds the insulation tight to the structural member and creates a uniform vapor spacing beneath the bottom of the roof panel.

The Sliding Anchor

Figure 2:
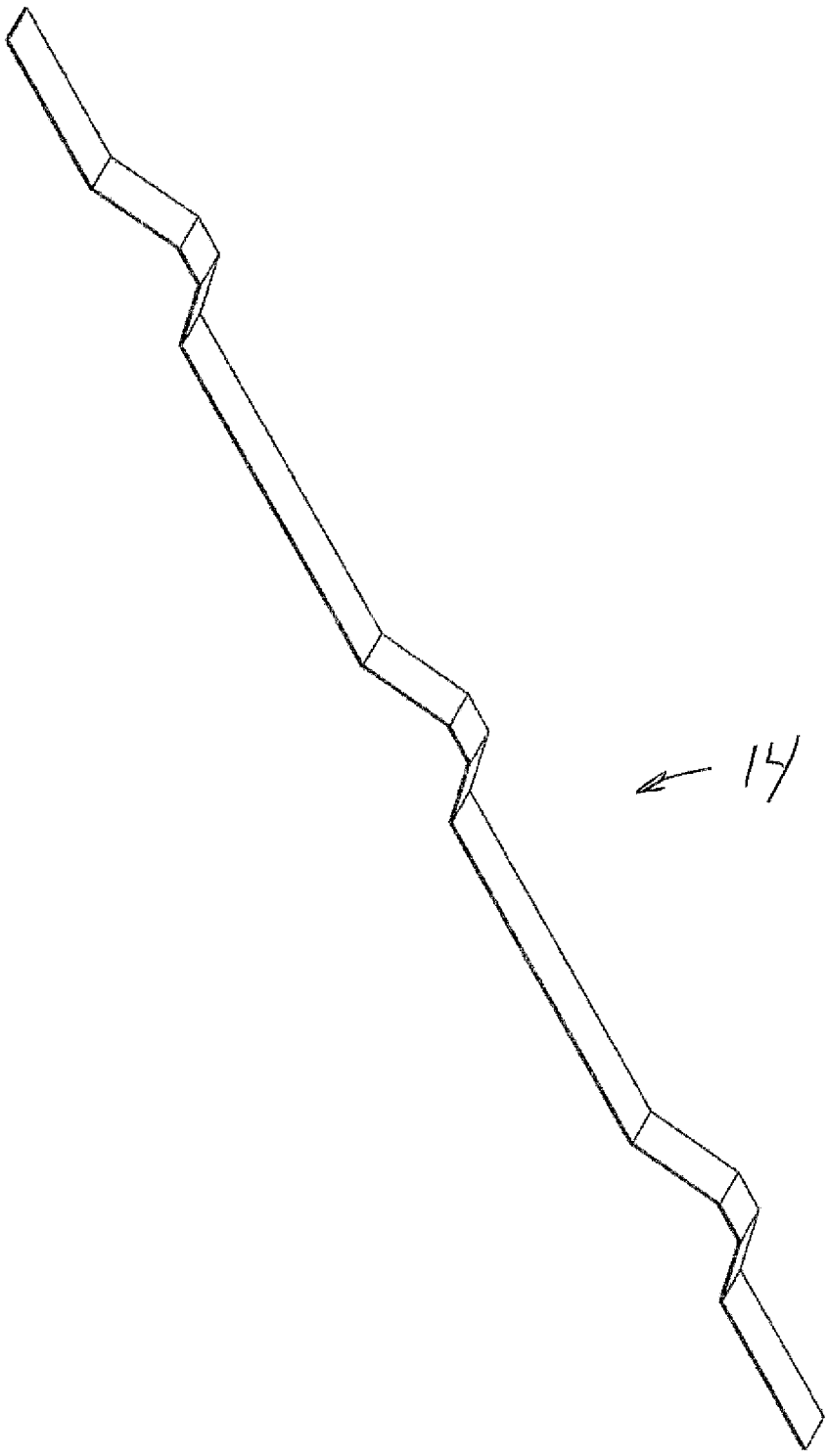
FIG. 2 is an isometric view of the sliding anchor of a preferred embodiment of the apparatus of the present invention used in structural applications (as installed with R-panels profiles)

The sliding anchor can be made of any metal thickness, type or shape to allow a connection to a bottom or top cleat (FIG. 2, 15, 23, #14). If a panel thickness is thicker than 16 gauge, the panel may preferably be directly connected to the sliding anchor without the use of the top or bottom cleat. Powder coating the anchor plate and sliding anchor with an ultra-hard high-density coating will allow the sliding anchor to easily slide within the anchor plate indefinitely.

The connection between the roof panel and sliding anchor or between the sliding anchor and grid can preferably be accomplished through screwing (FIGS. 30 & 31, #36), metal-to-metal interconnection, gluing or any combination of these. Panels are currently not glued to roof clips due to a restriction of thermal movement and the directional limitations of that thermal movement. The clip design allows the roof panel to be glued to the sliding anchor without hindering the thermal movement and does not have directional limitations. The sliding anchor can be any length and have as many anchor points as required. It can also be any width that fits through the sliding holes in the anchor plate.

The Support Grid

Figure 1:
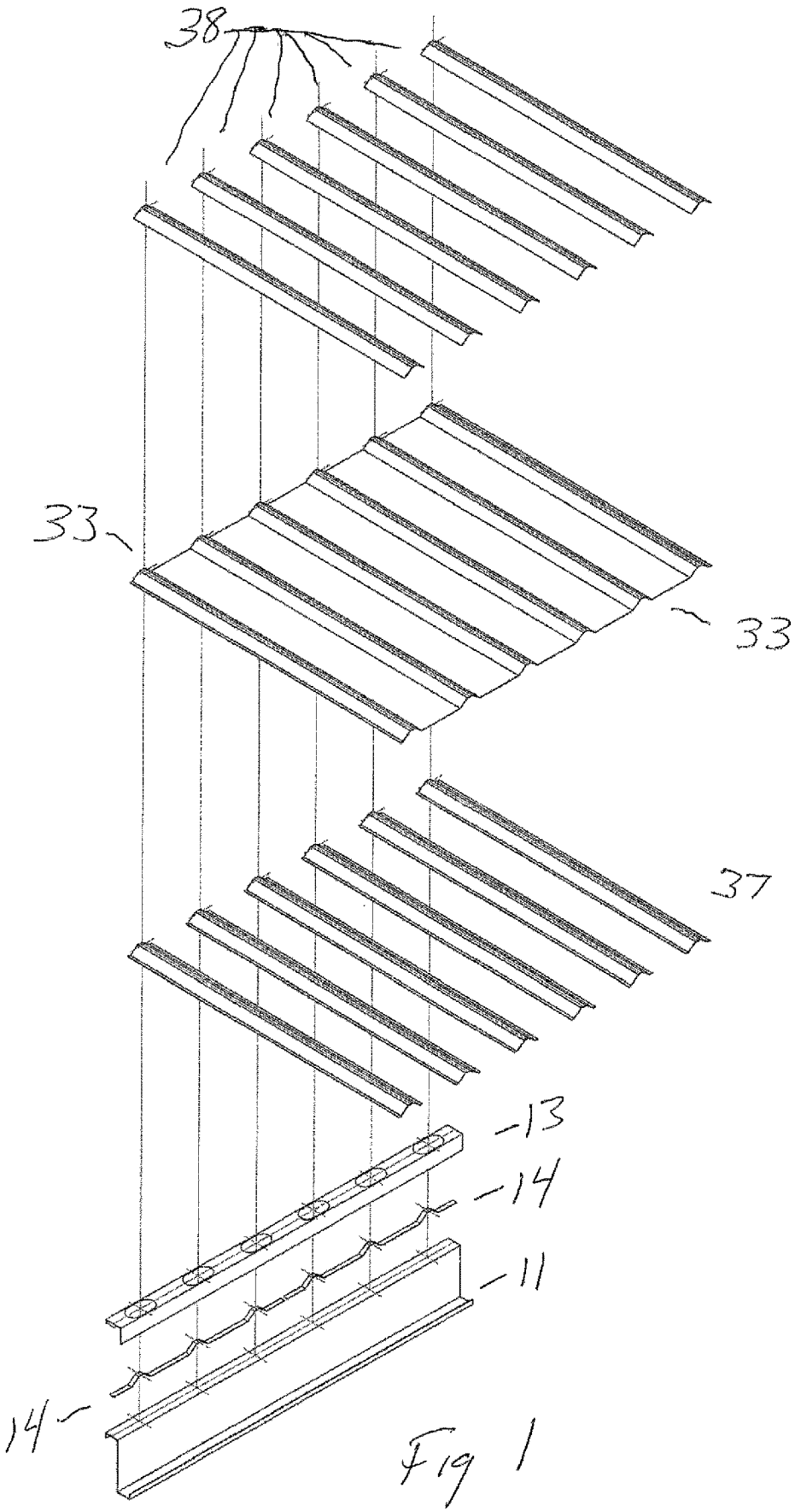
FIG. 1 is an exploded view of a preferred embodiment of the apparatus of the present invention showing the different components for Z-purlin application (structural)
Figure 17:
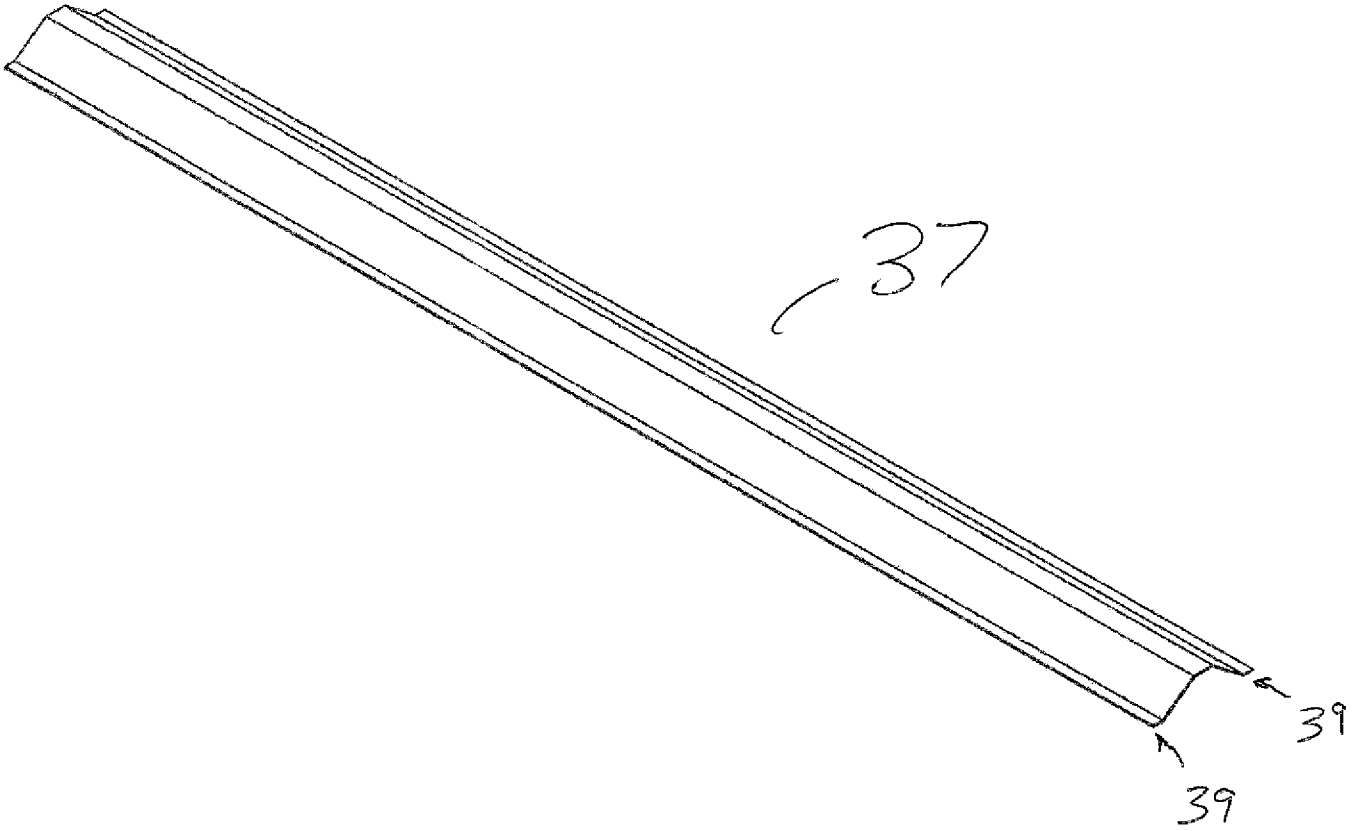
FIG. 17 is an isometric view of the bottom cleat of a preferred embodiment of the apparatus of the present invention (as installed with R-panel profiles)
Figure 19:
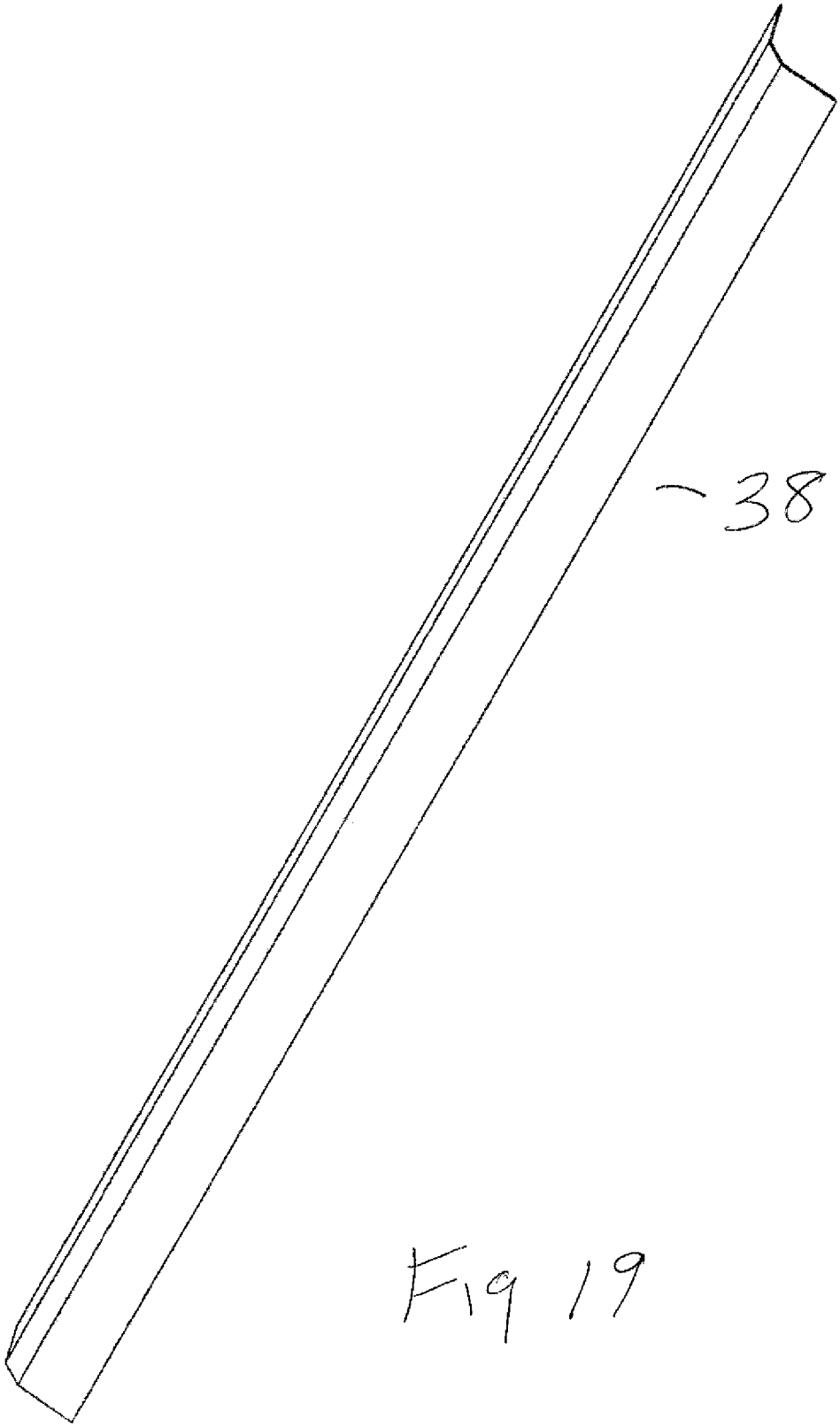
FIG. 19 is an isometric view of the top cleat of a preferred embodiment of the apparatus of the present invention (as installed with R-panel profiles)
Figure 21:
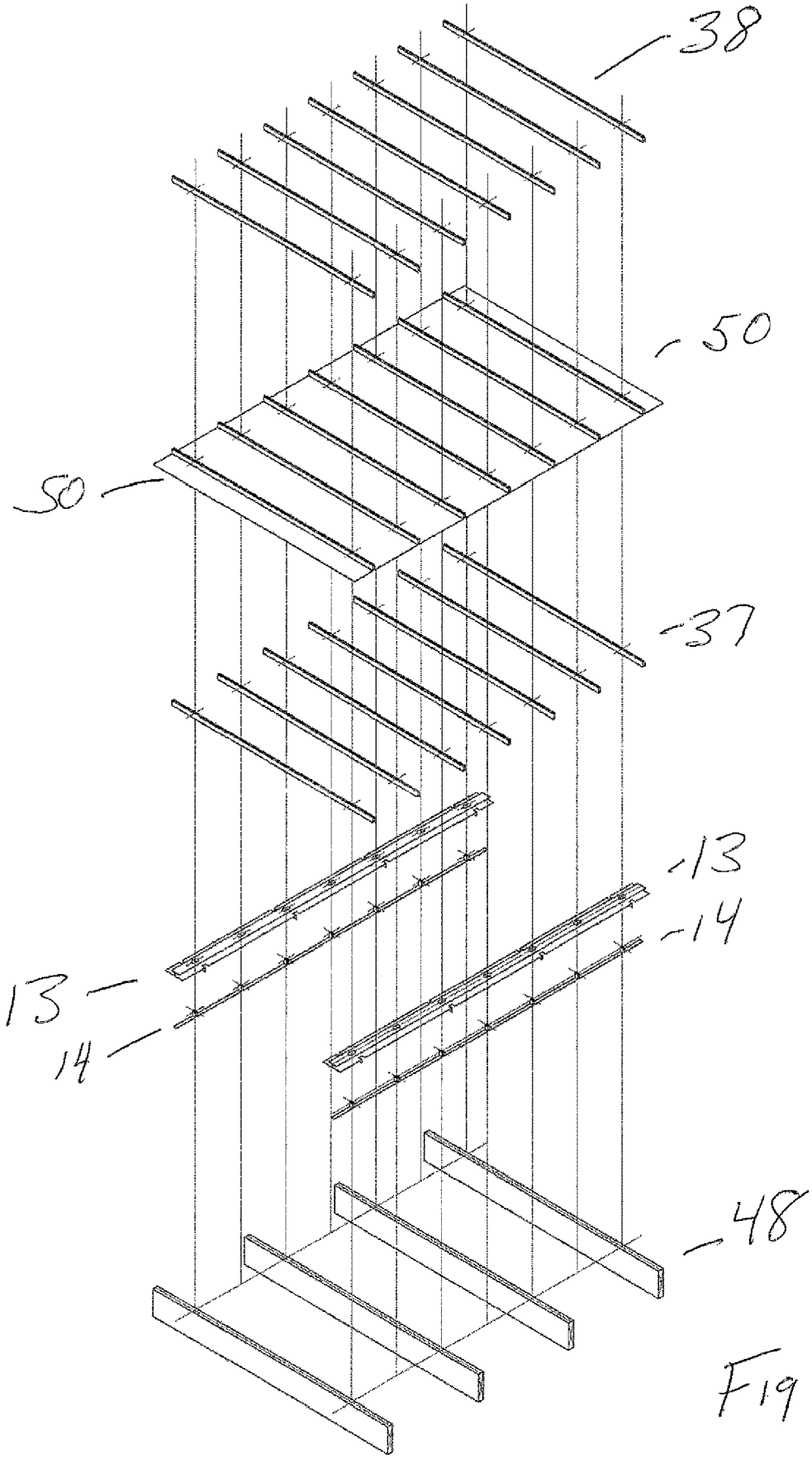
FIG. 21 is an exploded view of a preferred embodiment of the apparatus of the present invention showing the different components for architectural application (nonstructural)
Figure 22:
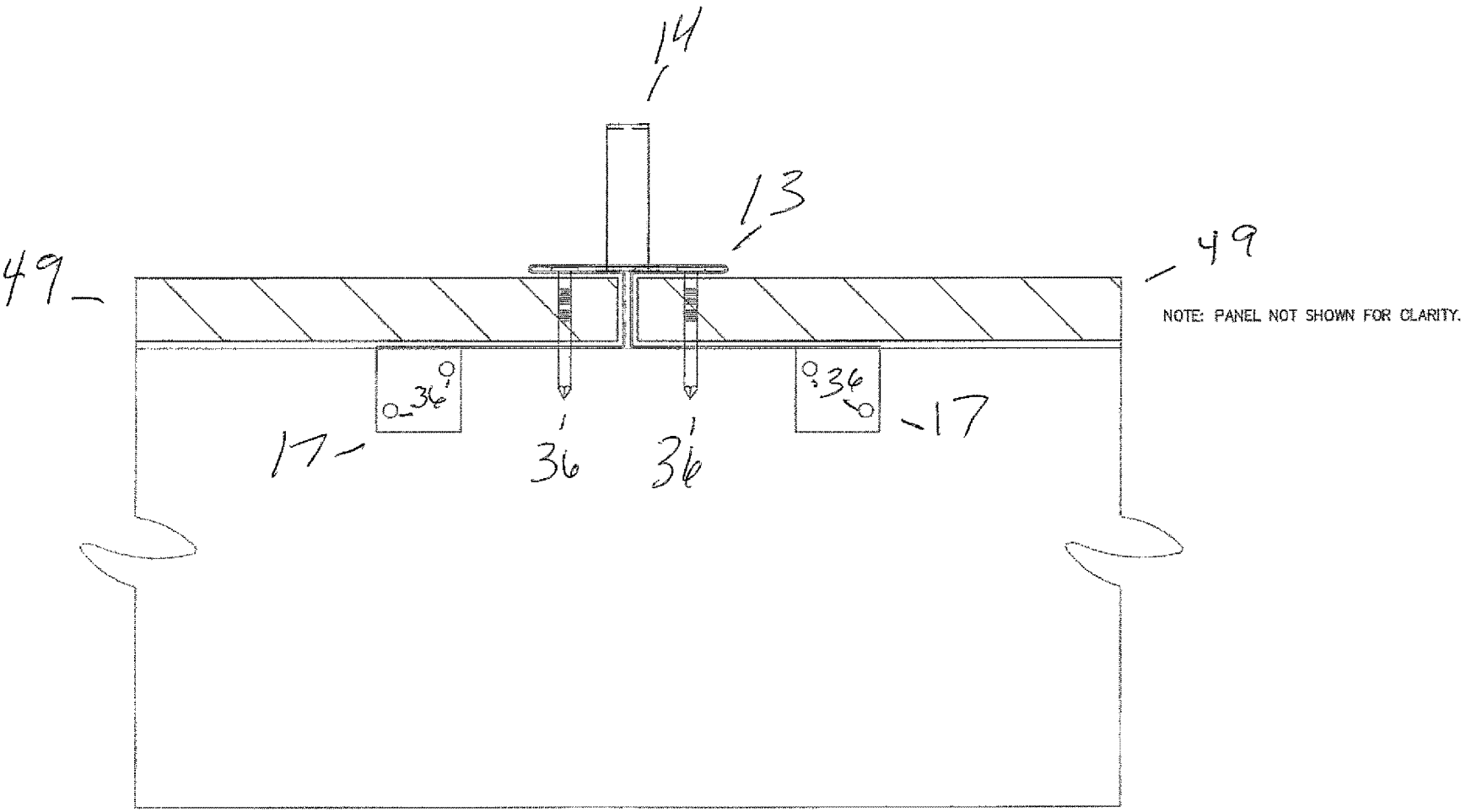
FIG. 22 is a sectional view of a preferred embodiment of the apparatus of the present invention showing an anchor body and sliding anchor installed over a decking and rafter system (nonstructural application)
Figure 23:
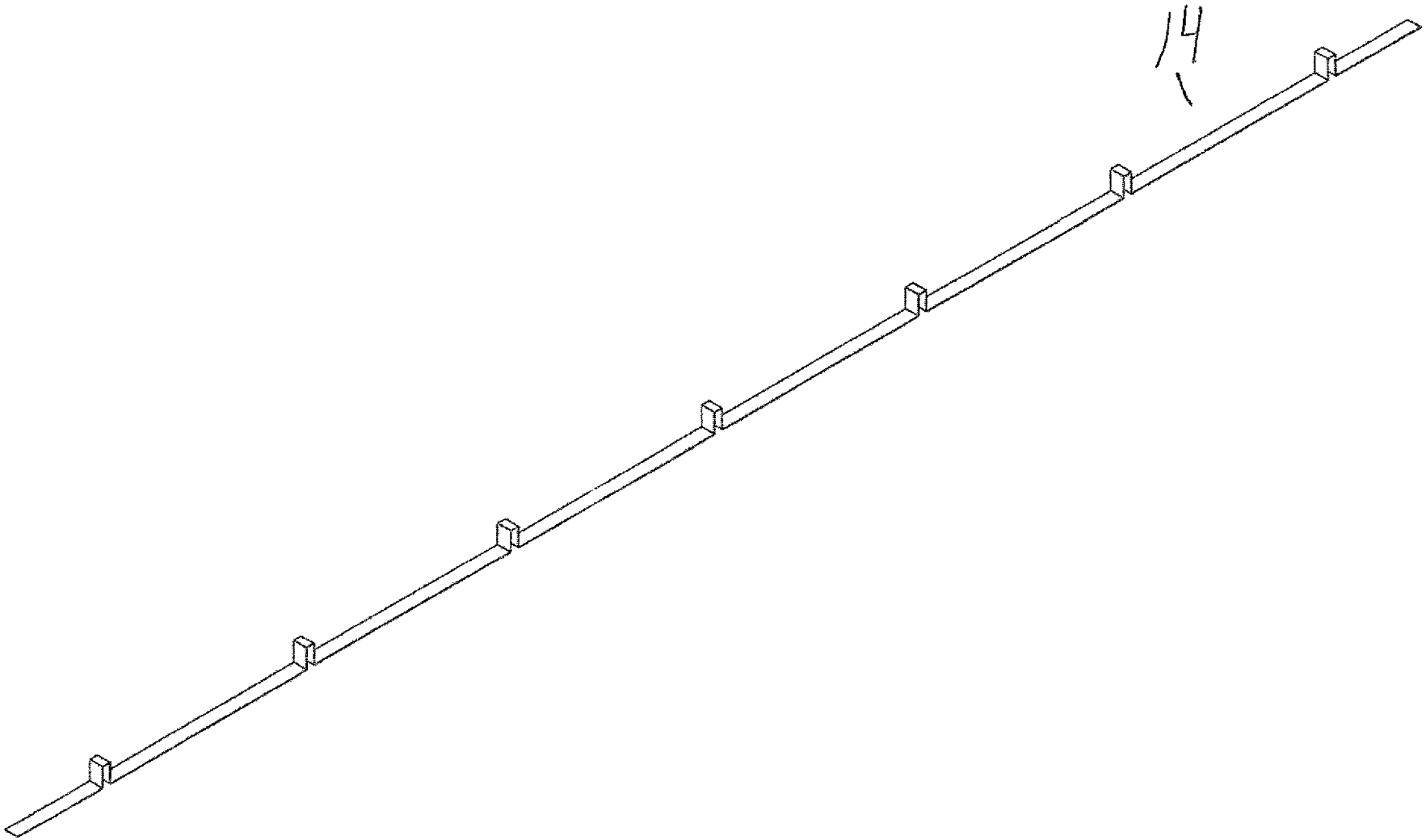
FIG. 23 is an isometric view of the sliding anchor of a preferred embodiment of the apparatus of the present invention used in roof and wall applications (as installed with a standing seam profiles)
Figure 26:
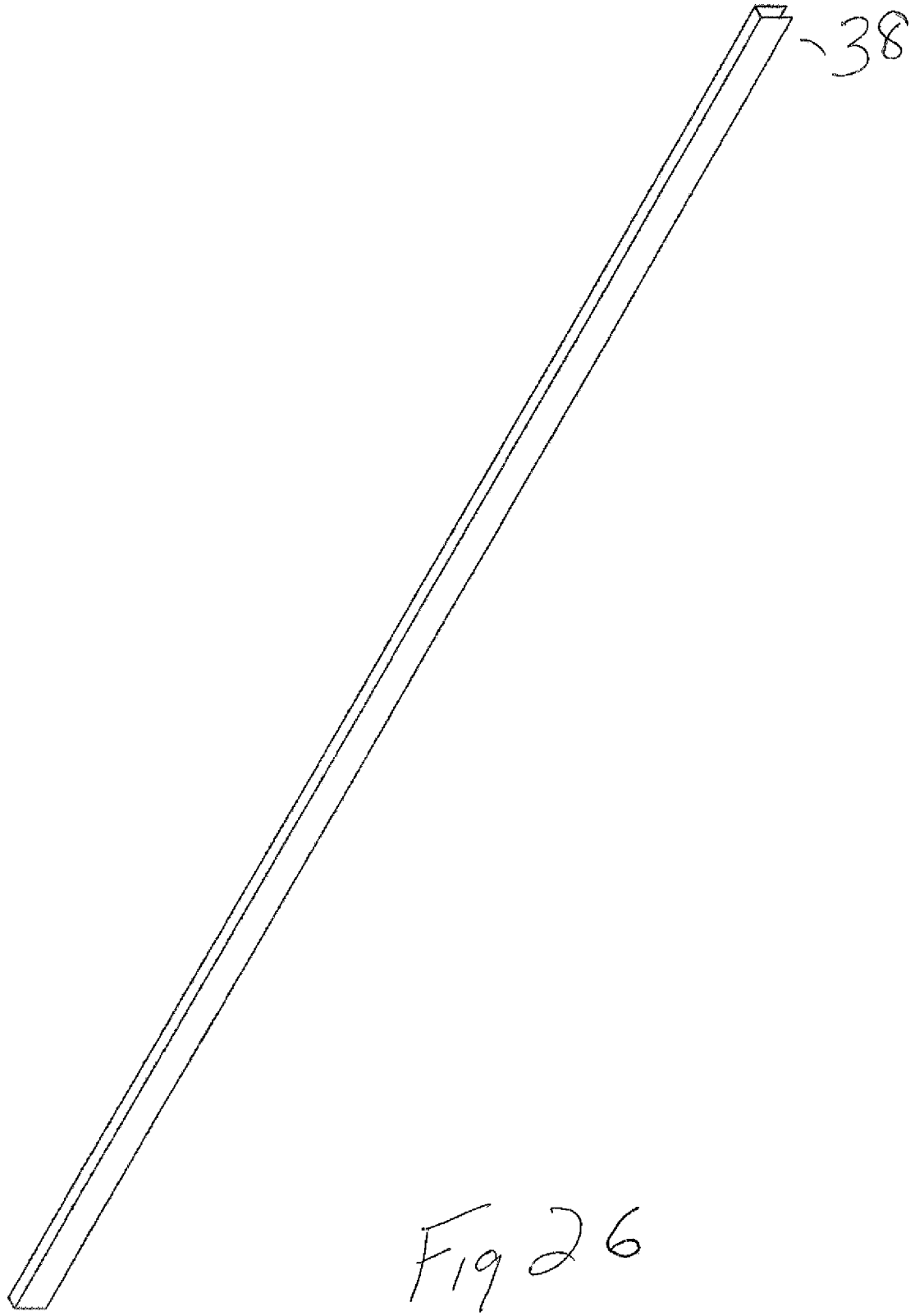
FIG. 26 is an isometric view of the bottom cleat of a preferred embodiment of the apparatus of the present invention (as installed with a Tandem300™ panel profile)

The support grid is made up of a bottom cleat (FIG. 17) or a top cleat (FIGS. 19 & 26) or both a bottom and top cleat (FIG. 1, #37 & #38). The cleats are preferably in the same shape of the sliding anchor so that the bottom cleat can be passed through the sliding anchor or the top cleat can mate up over the top of the sliding anchor (FIG. 13, #14 & #37). When a bottom cleat is used, the cleat is preferably passed through one or more clips anchor slides (FIG. 21, #13 & #37). The ends of the bottom cleat are preferably overlapped with the bottom cleats above and below as they run from the ridge to the eave. A screw placed in the top of the bottom cleat ties the bottom cleats together within each run of bottom cleat. Cleats can be of any length, but are expected to be about 12 feet in length.

Figure 4:
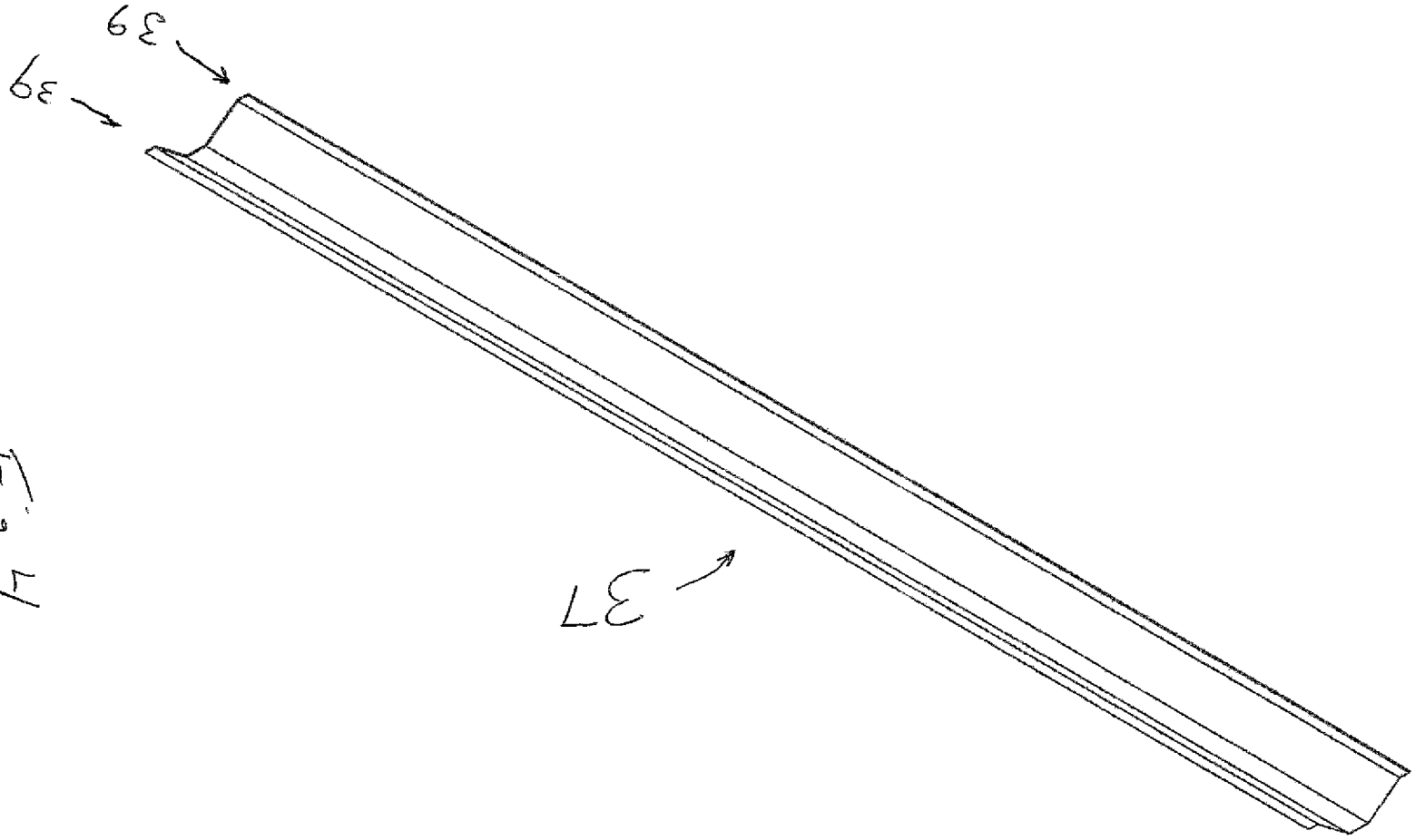
FIG. 4 is an isometric view of the bottom cleat of a preferred embodiment of the apparatus of the present invention (as installed with R-panel profiles)
Figure 6:
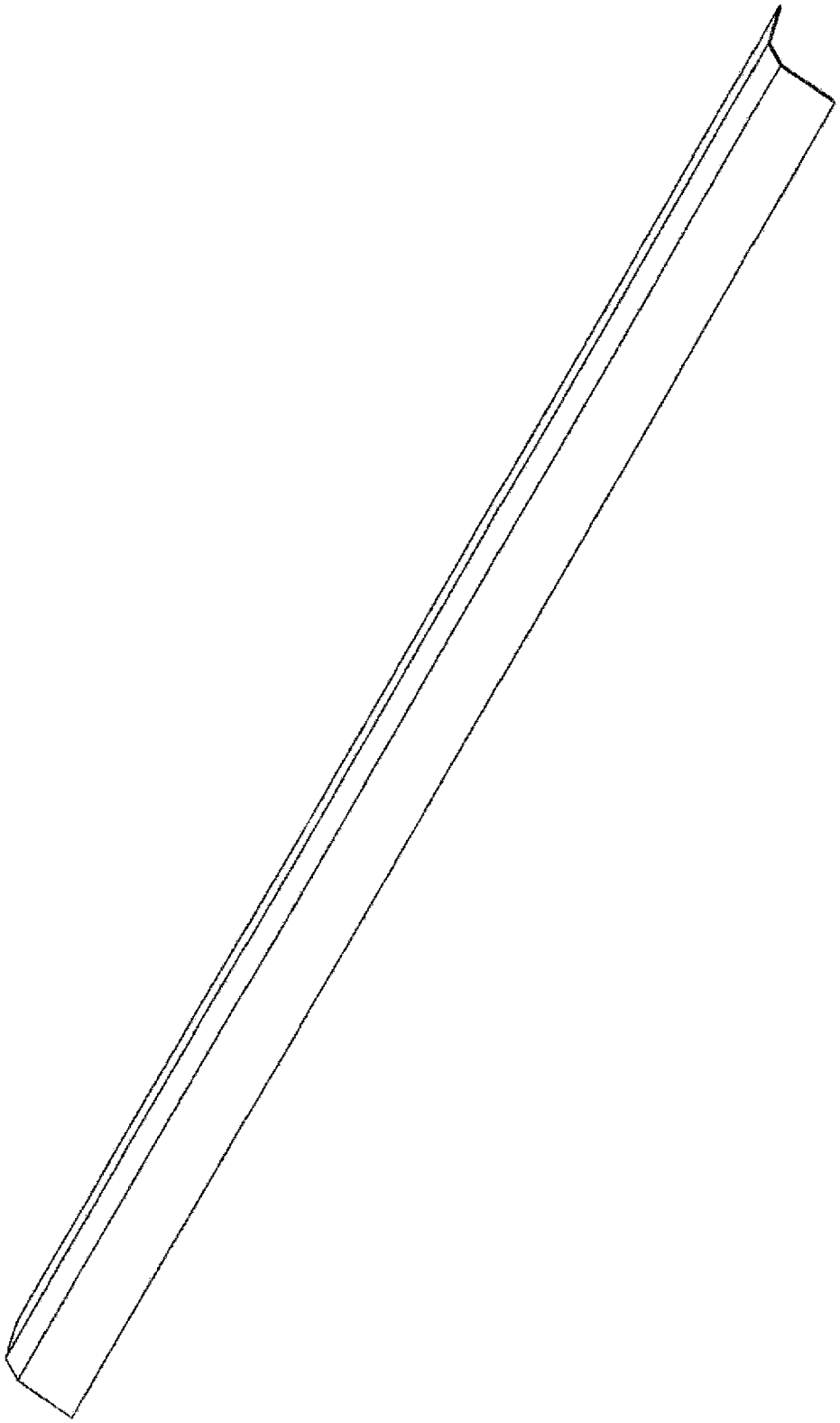
FIG. 6 is an isometric view of the top cleat of a preferred embodiment of the apparatus of the present invention (as installed with R-panel profiles)
Figure 7:
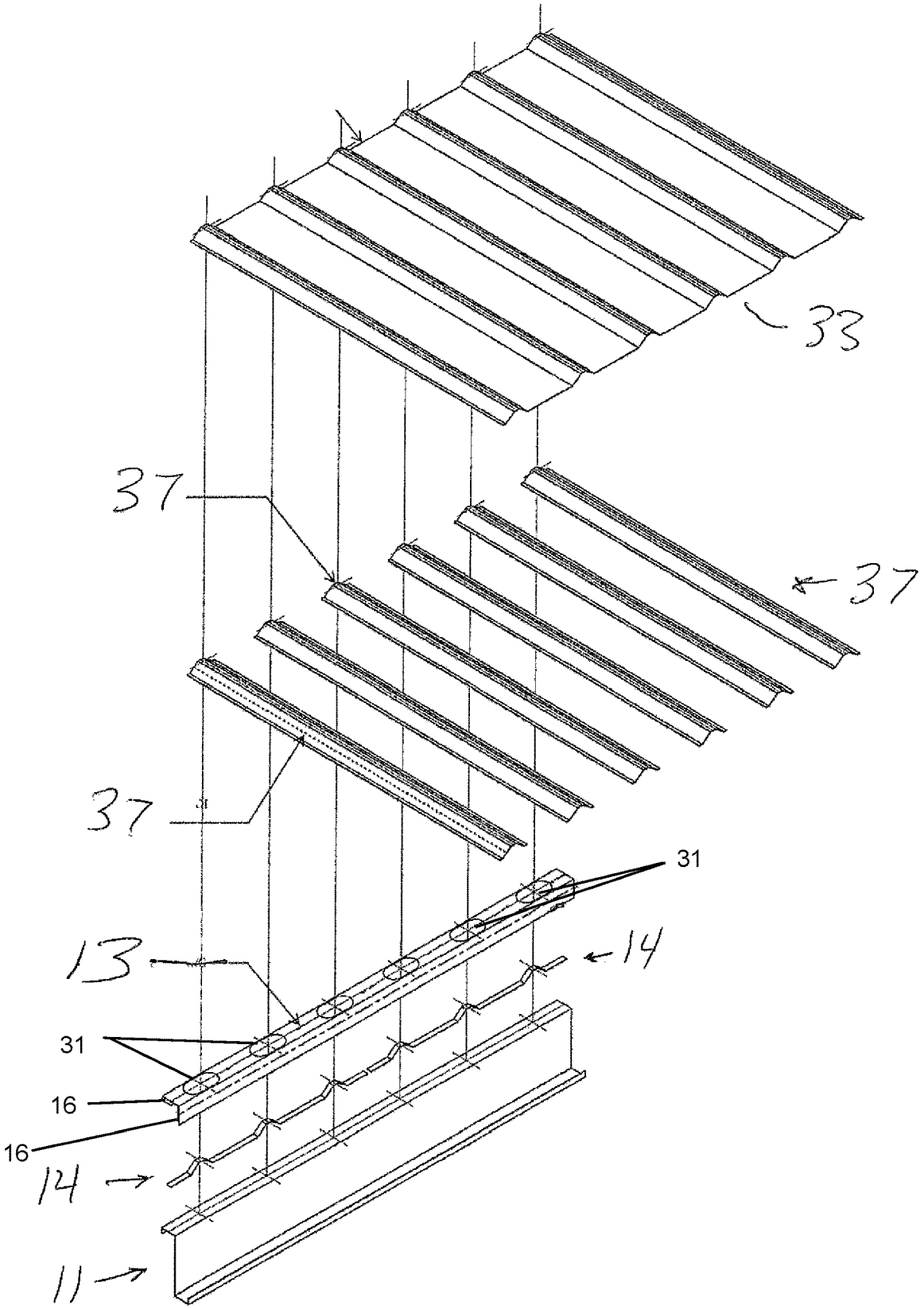
FIG. 7 is an exploded view of a preferred embodiment of the apparatus of the present invention showing the different components for Z-purlin application with heavier gauge roof panel (does not require use of top cleat)
Figure 8:
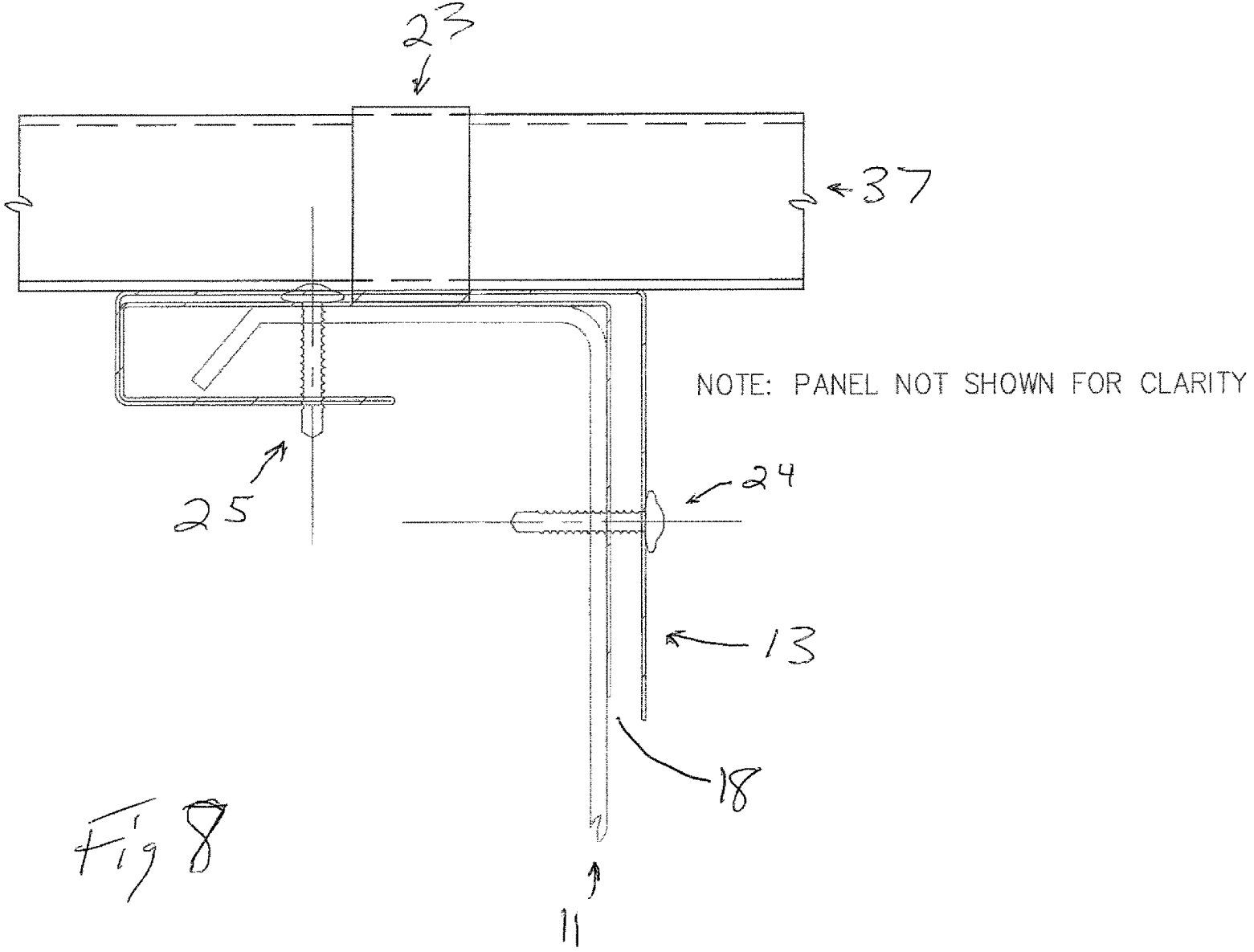
FIG. 8 is a sectional view of a preferred embodiment of the apparatus of the present invention showing an anchor body, sliding anchor and bottom cleat installed over a Z-purlin (structural application)

The bottom cleat preferably has two purlin bearing legs that rest on and move over the surface of the anchor plate (FIG. 4, #39). The top cleat does not have purlin bearing legs (FIG. 6). When cleats are installed with a metal roof panel, the combined unit is free to expand and contract in any direction due to thermal movement. The thickness of the cleat metal can preferably be as thin as 26 gauge and as thick as 10 gauge. The typical metal thickness of the cleats will preferably be 18 gauge.

The Panels

Figure 5:
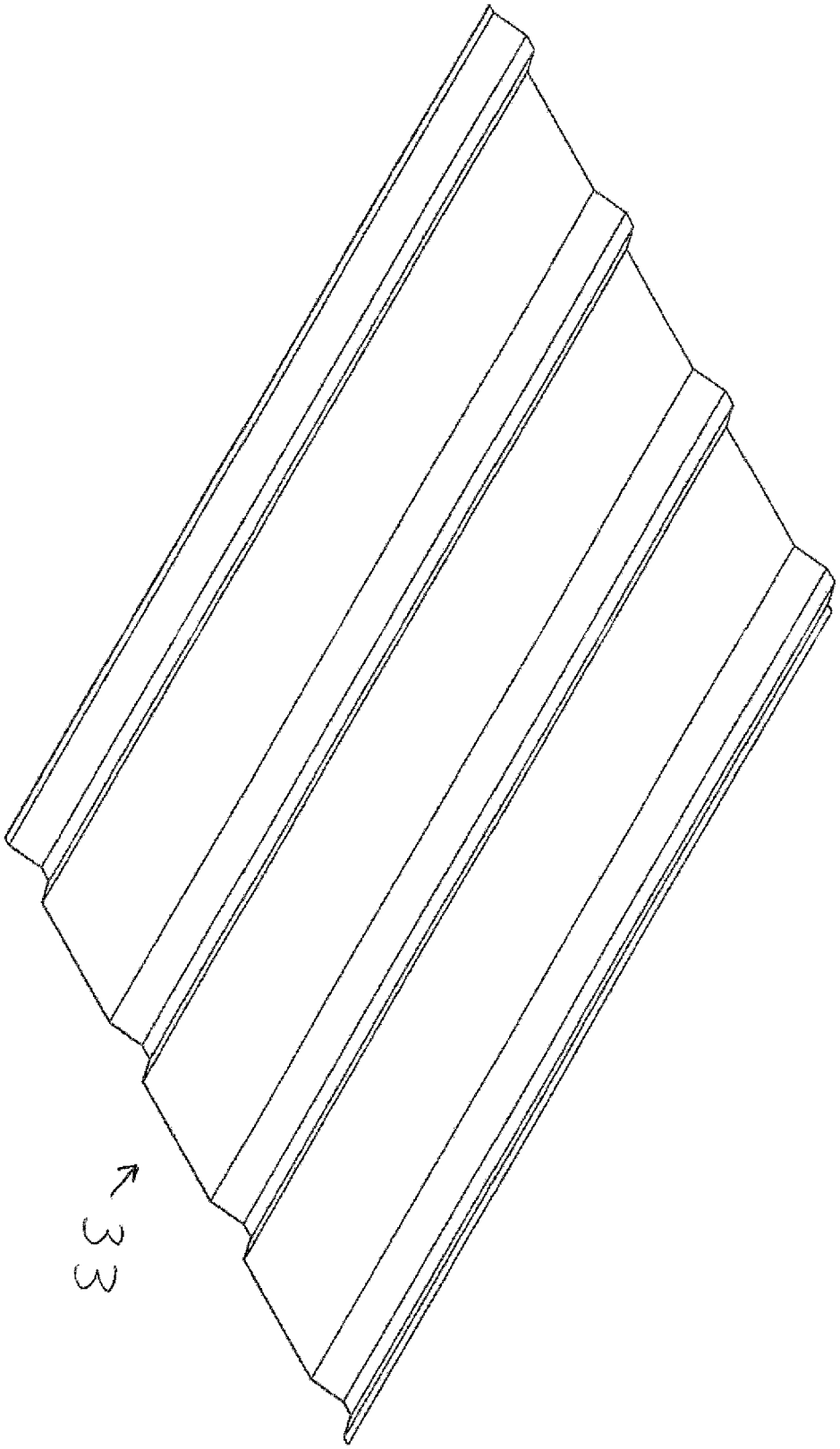
FIG. 5 is a partial isometric view of the R-panel of a preferred embodiment of the apparatus of the present invention (R-panel profile is one of many corrugated panel profiles available in the industry of which any corrugated profile can be used with the present invention)
Figure 18:
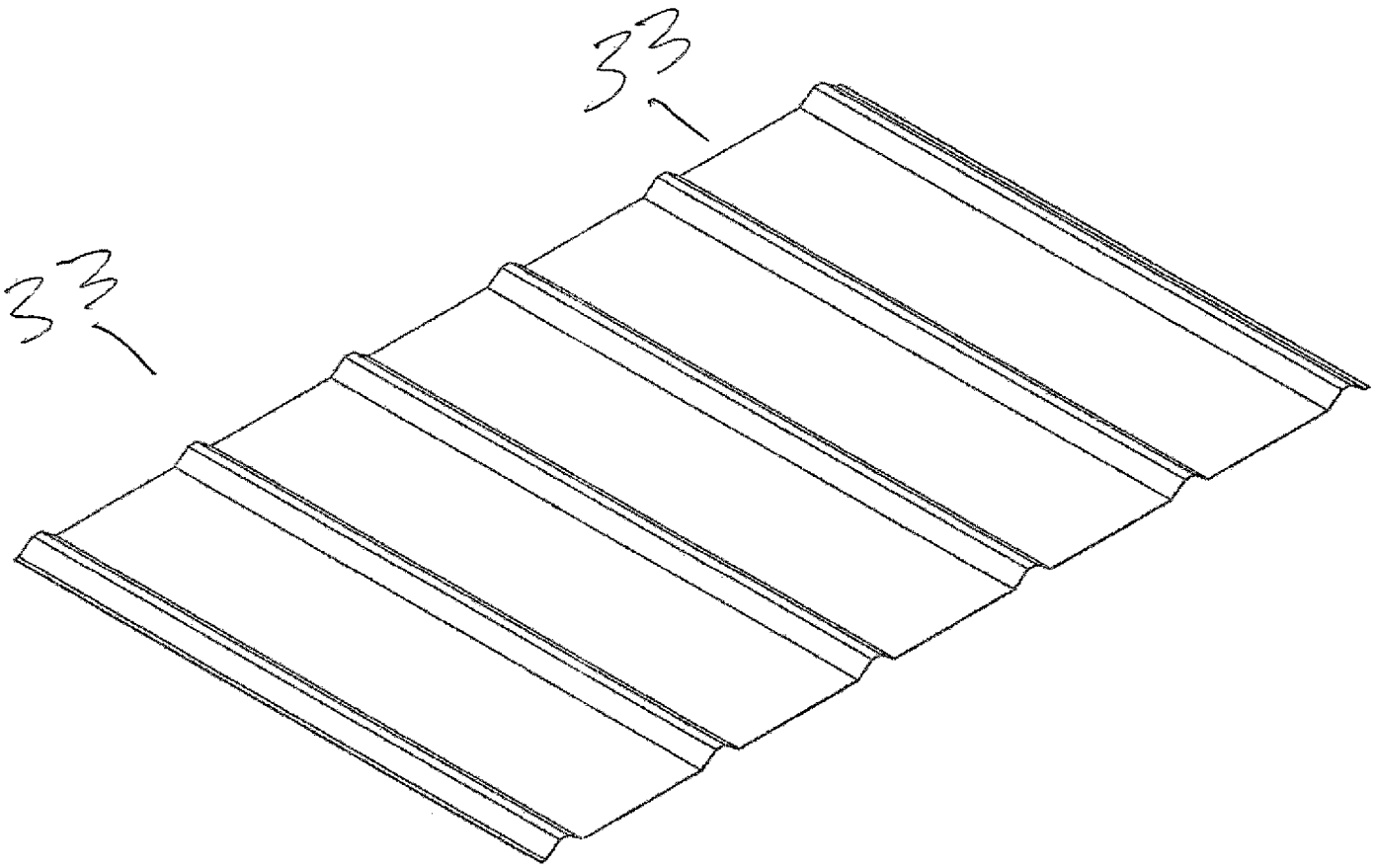
FIG. 18 is a partial isometric view of the R-panel of a preferred embodiment of the apparatus of the present invention (R-panel profile is one of many corrugated panel profiles available in the industry of which any corrugated profile can be used with the present invention)
Figure 25:
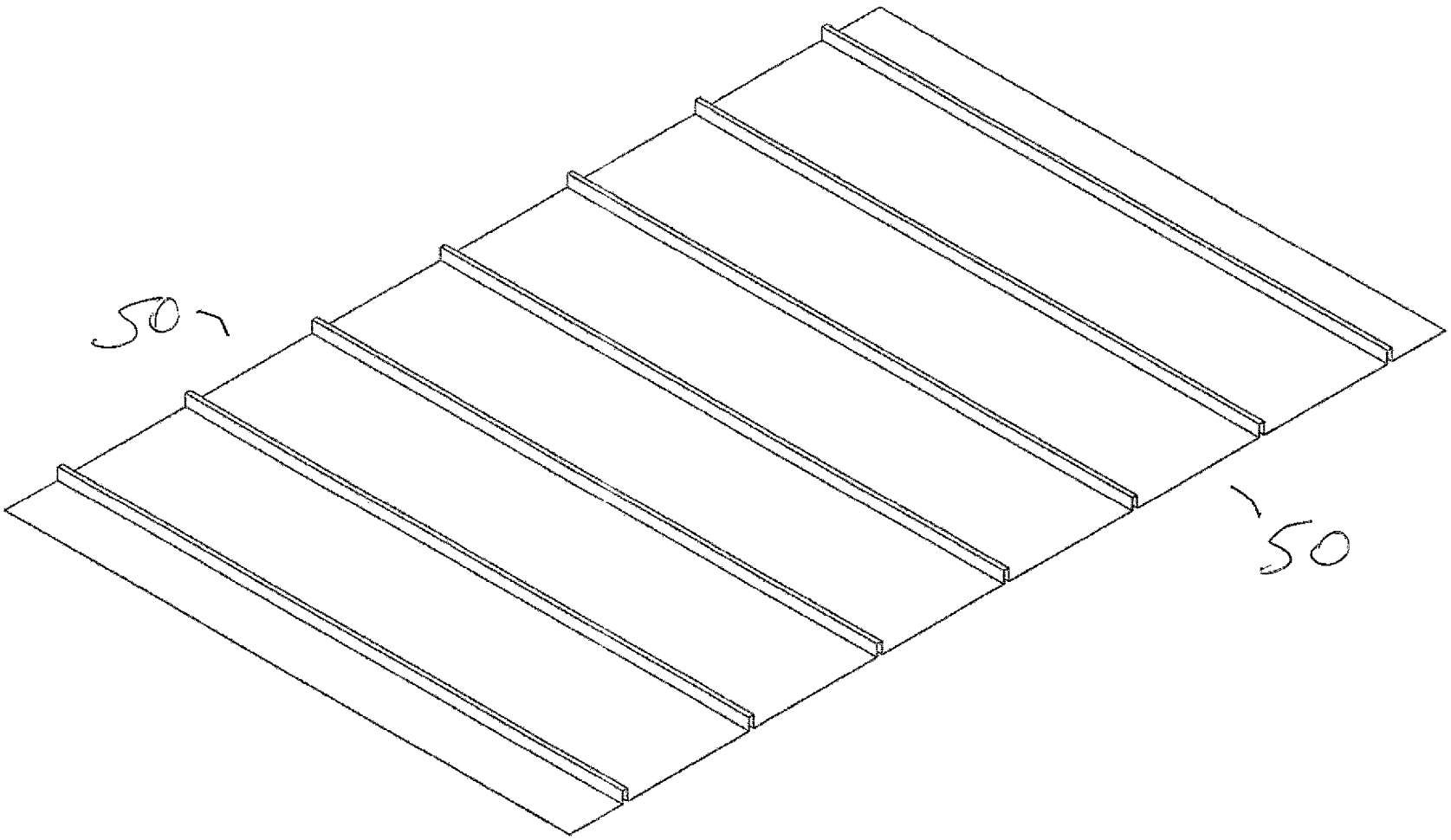
FIG. 25 is a partial isometric view of the Tandem300™ standing seam panel of a preferred embodiment of the apparatus of the present invention (standing seam panel profile is one of many standing seam panel profiles available in the industry of which any standing seam profile can be used with the present invention however the Tandem300™ standing seam panel profile is unique in that it does not have any internal attachment methods)

The panels used with the present invention can preferably be standing seam panels, R-panels, corrugated panels, or any other formed metal or nonmetal panels readily available in the market place. For structural applications, it is expected that R-panels will be typically used (FIGS. 5 & 18). For nonstructural applications, it is expected that the Tandem™ standing seam panel will be used (FIG. 25).

Current residential and architectural roof panels are typically a nonstructural panel system. These types of roof panels have to be installed over a wood or metal deck. Roof clips are then fastened to the decking with screws. The decking is attached to a roof rafter system, which can be composed of wood or metal members. The rafter system is attached to the side walls of the building structure. Hurricane strips are added to the side wall/rafter system to insure the rafters can withstand high wind loads. The roof panels, clips and decking is not strapped to the rafter system making those components susceptible to being damaged or blown away in high wind loading conditions.

Figure 29:
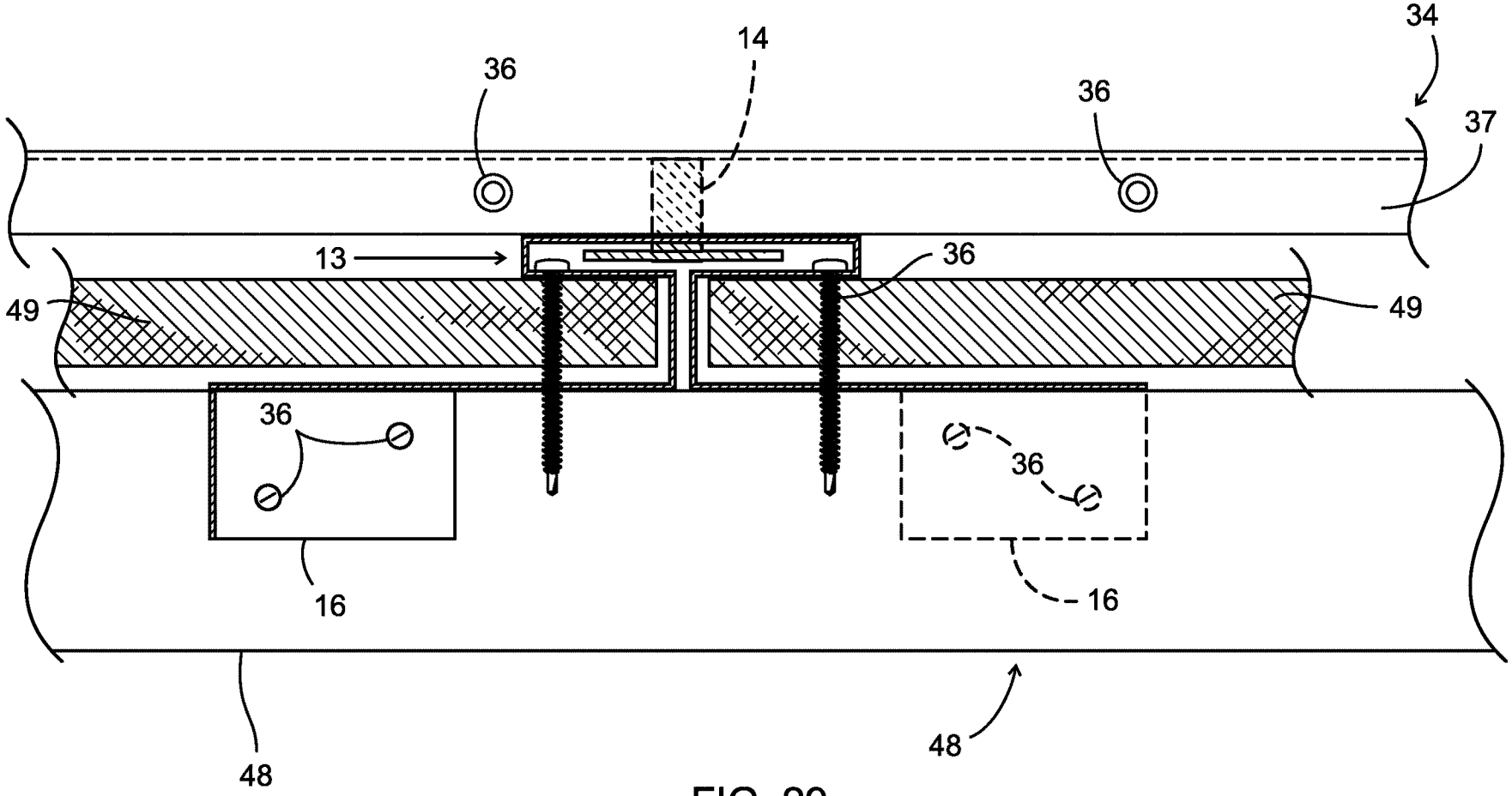
FIG. 29 is a sectional view of a preferred embodiment of the apparatus of the present invention showing an anchor body, sliding anchor, bottom cleat and R-panel installed over a decking and rafter system (nonstructural application)
Figure 30:
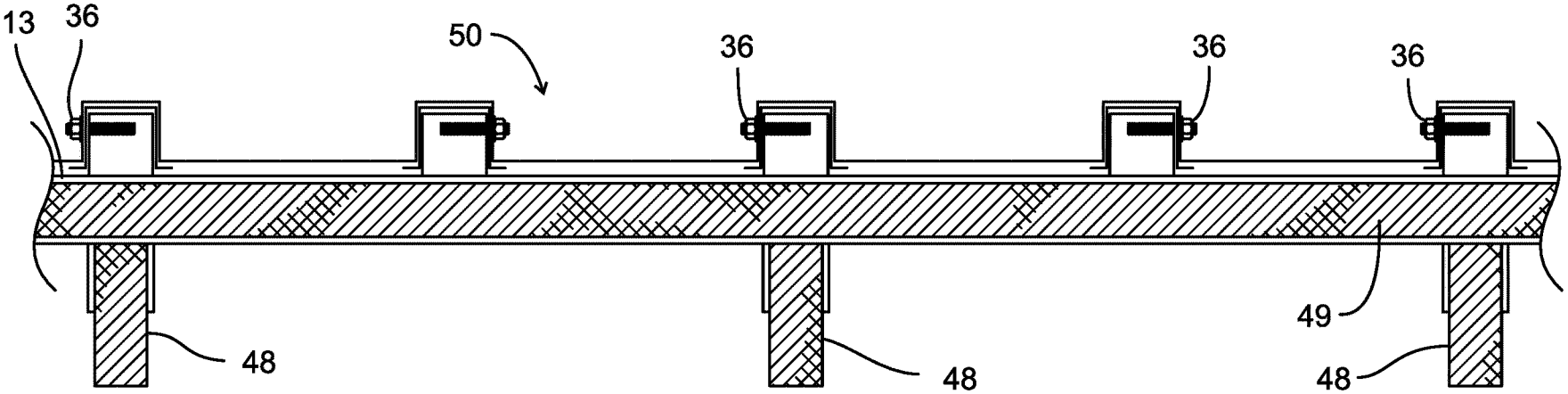
FIG. 30 is a sectional view of a preferred embodiment of the apparatus of the present invention showing an anchor body, sliding anchor, bottom cleat, top cleat and Tandem300™ standing seam panel installed over a decking and rafter system (nonstructural application)
Figure 31:
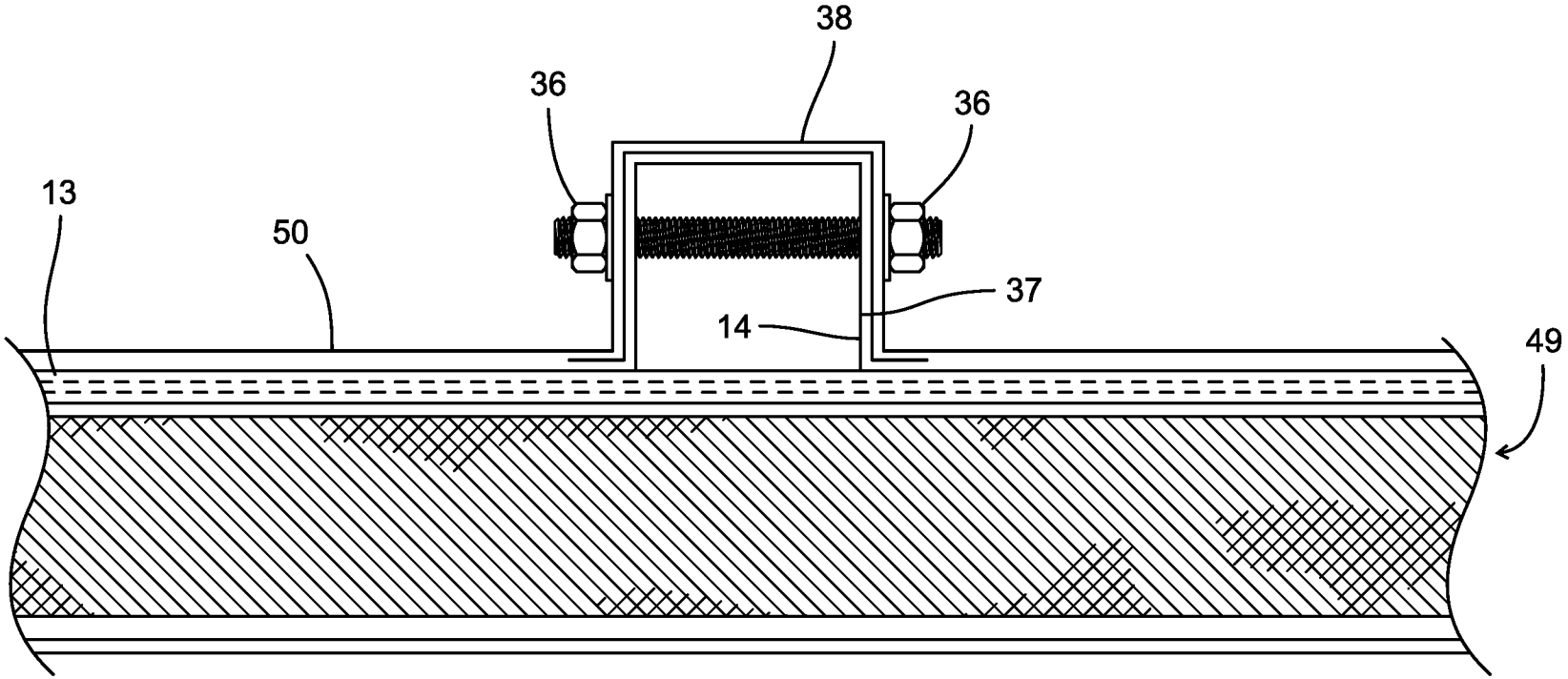
FIG. 31 is a close-up sectional view of a preferred embodiment of the apparatus of the present invention showing an anchor body, sliding anchor, bottom cleat, top cleat, screws and Tandem300™ standing seam panel installed over a decking and rafter system (nonstructural application)

The Tandem™ standing seam panel is unique to the market place in that it is through-fastened to the grid system (FIG. 30, #36). The high of the Tandem™ standing seam panel is attached to the grid by a fastener passing through the side wall of the rib utilizing shearing forces instead of pullout (FIG. 31, #36, #37, #38). The Tandem™ standing seam panel can also be used in structural applications as a structural panel system. When the Tandem™ standing seam panel is combined with the residential anchor plate roof system, the entire system is hurricane strapped to the roof rafters (FIG. 29, #16). This is the only system providing hurricane strapping of the deck, clip and panel system across an entire roof/rafter area.

The panels of the present invention can be made of any length, but are most likely up to 40-foot lengths (the longest that can be trucked easily), but will be similar to a standing seam roof in that they will be virtually leak free (as the only screws go through the side walls of the ribs and not located in the water zone).

In residential/architectural/nonstructural applications, when heavier gauge metal panels (greater in thickness than 22 gauge) are used for wall/roof applications, then wood/metal decking would not be required to be installed beneath the panel for support. The anchor plate would preferably not have the spacing area for the decking, but would preferably still retain the hurricane flanges. The anchor plate would preferably still attach to the studs/rafters in the same manner as the decking anchor plate through the use of shearing resistance. The area containing the sliding anchor of the anchor plate would preferably not change.

The Flashing Clips

Figure 32:
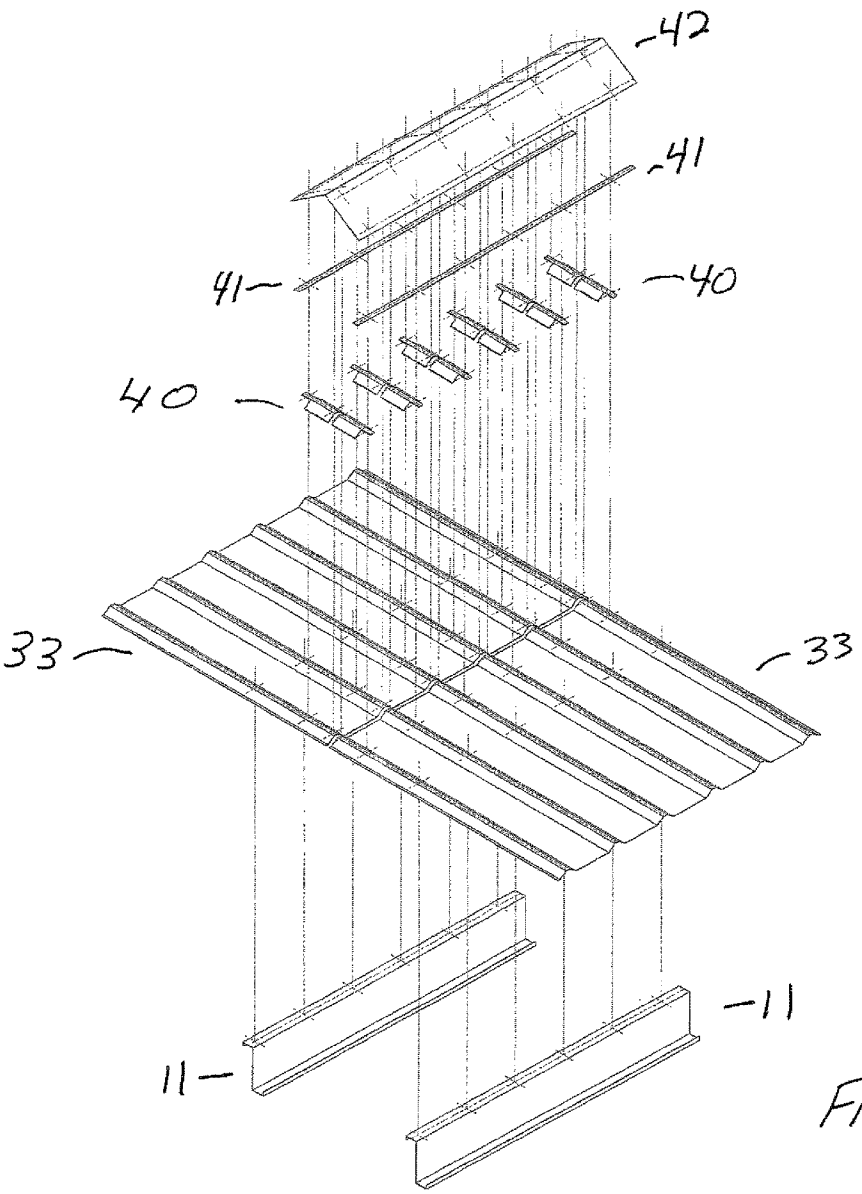
FIG. 32 is an exploded view of a preferred embodiment of the apparatus of the present invention showing the different components of ridge flashing for both structural and nonstructural applications.
Figure 33:
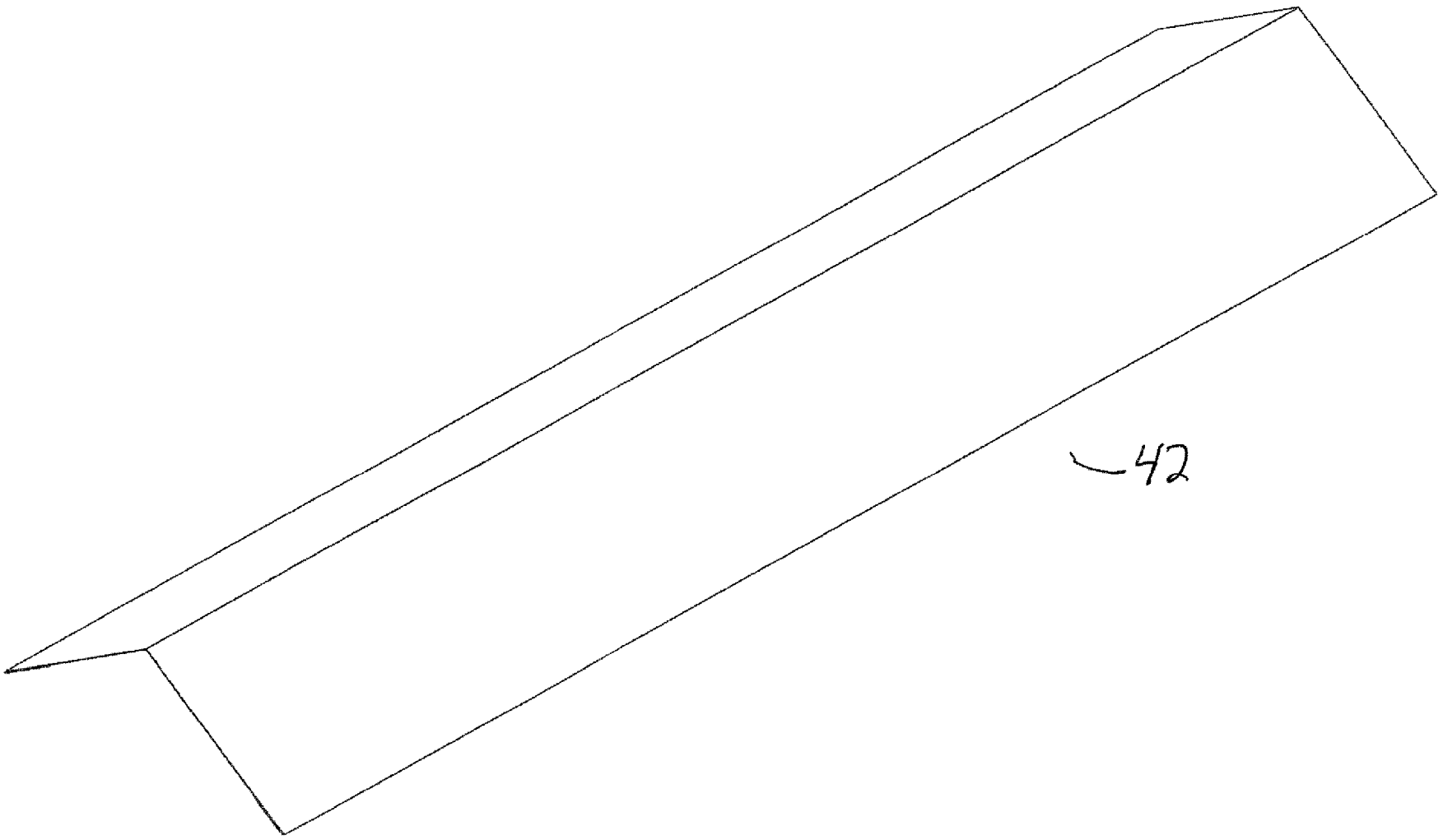
FIG. 33 is an isometric view of the ridge cap flashing of a preferred embodiment of the apparatus of the present invention.
Figure 39:
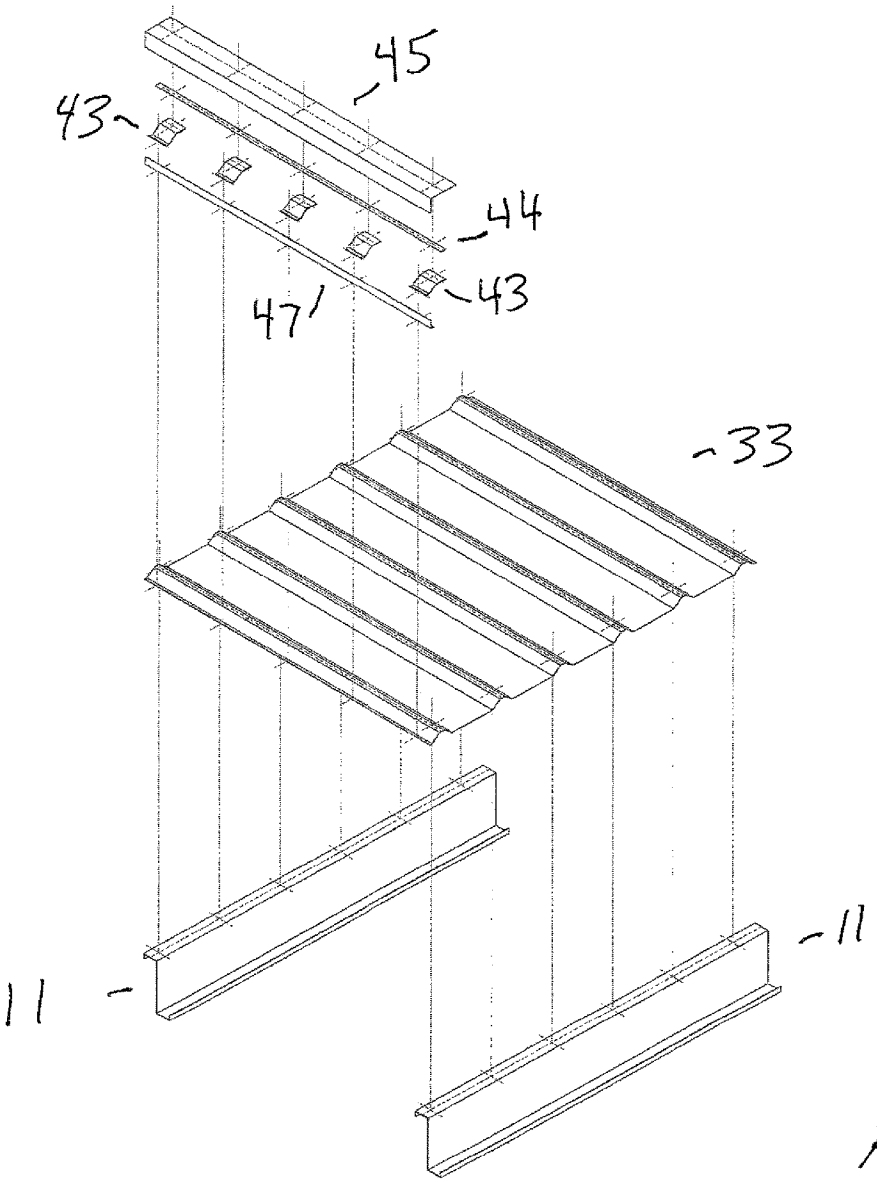
FIG. 39 is an exploded view of a preferred embodiment of the apparatus of the present invention showing the different components of rake flashing for both structural and nonstructural applications.
Figure 40:
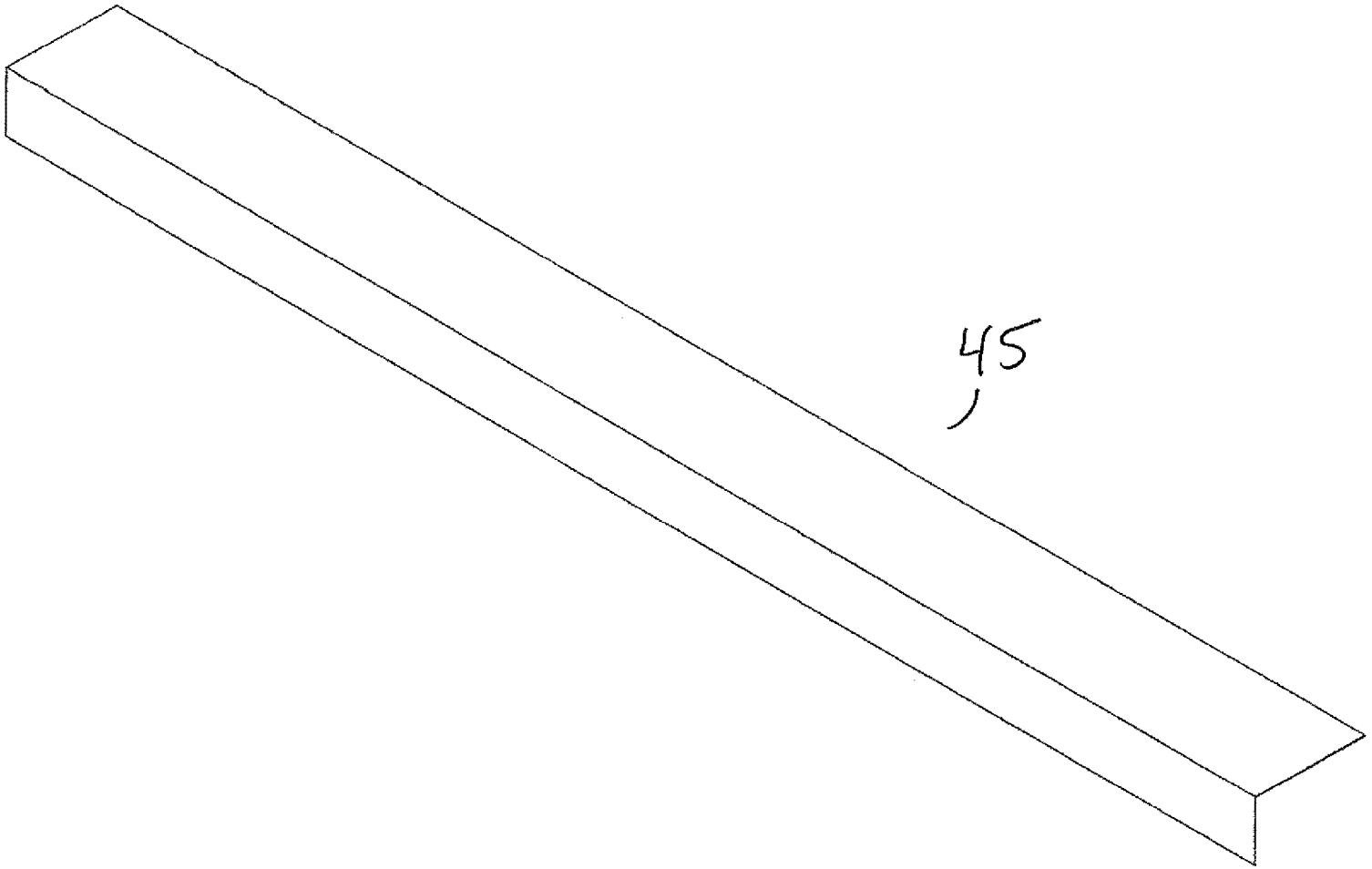
FIG. 40 is an isometric view of the rake flashing of a preferred embodiment of the apparatus of the present invention.
Figure 41:
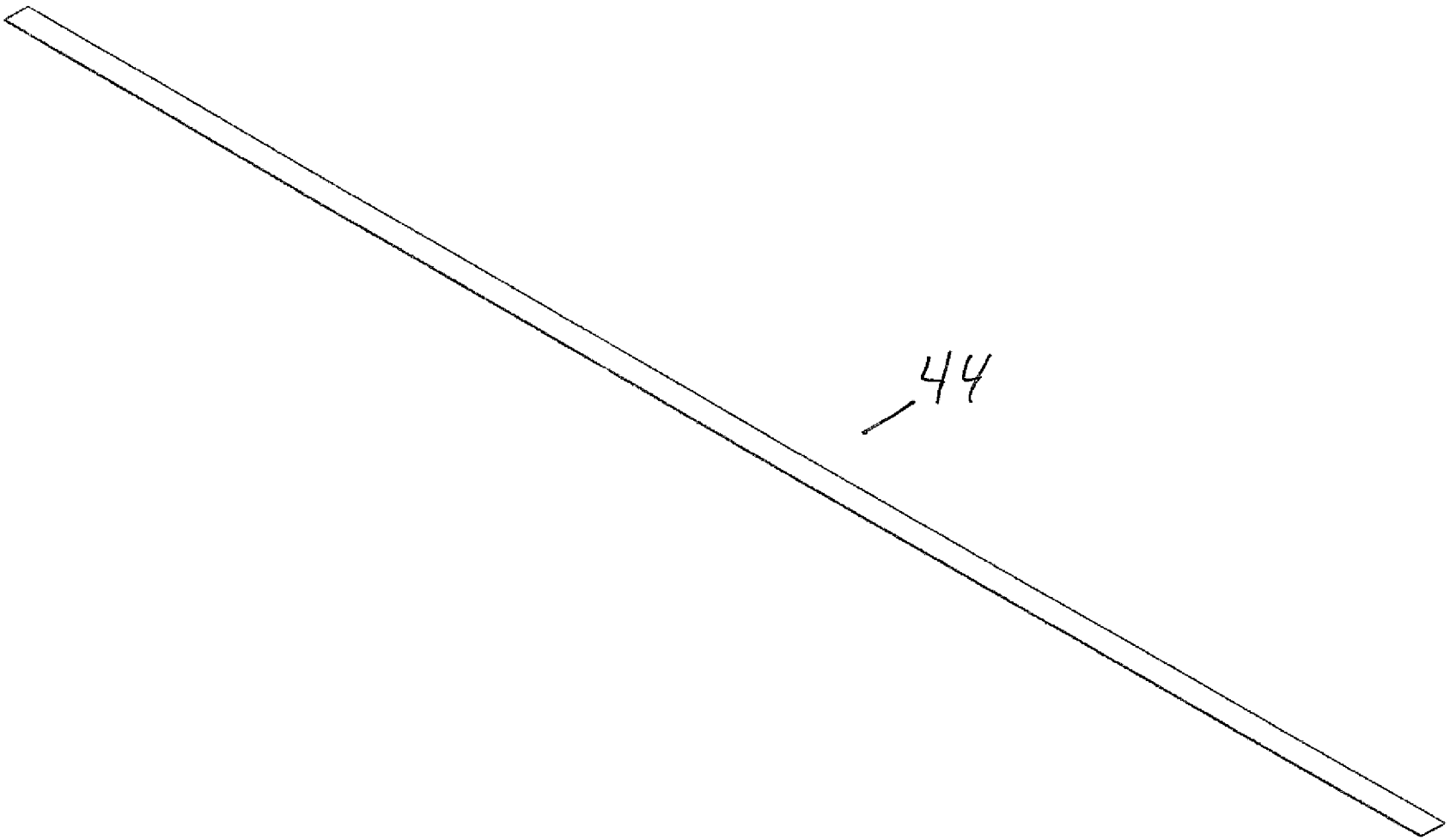
FIG. 41 is an isometric view of the rake sliding anchor of a preferred embodiment of the apparatus of the present invention used in both structural and nonstructural applications.

Roof flashings typically seal up the top, perimeters, and penetrations of the roof system. The top of a roof where two or more planes of roofing panel meet is called the ridge (FIG. 32). Ridge capping is the flashing that spans the planes of roofing (FIG. 33). The side perimeter of a sloped plane of roofing is called the rake (FIG. 39) and the flashing that wraps around the roof and side walls of a building is called the rake flashing (FIG. 40). When a wall extends above a roof plane, then wall flashing is used to seal the wall/roof joint. Likewise, when vents or pipes protrude through a roof plane, vent and/or pipe flashing is used to seal the area of transition.

Flashings are typically the weak point of any roof system. Fastening flashing across multiple planes that experience thermal movement in different rates and/or directions causes fasteners to become loose or damaged over time. While a roof panel system may be able to withstand 150 mph wind, the flashing typically cannot over time.

Figure 35:
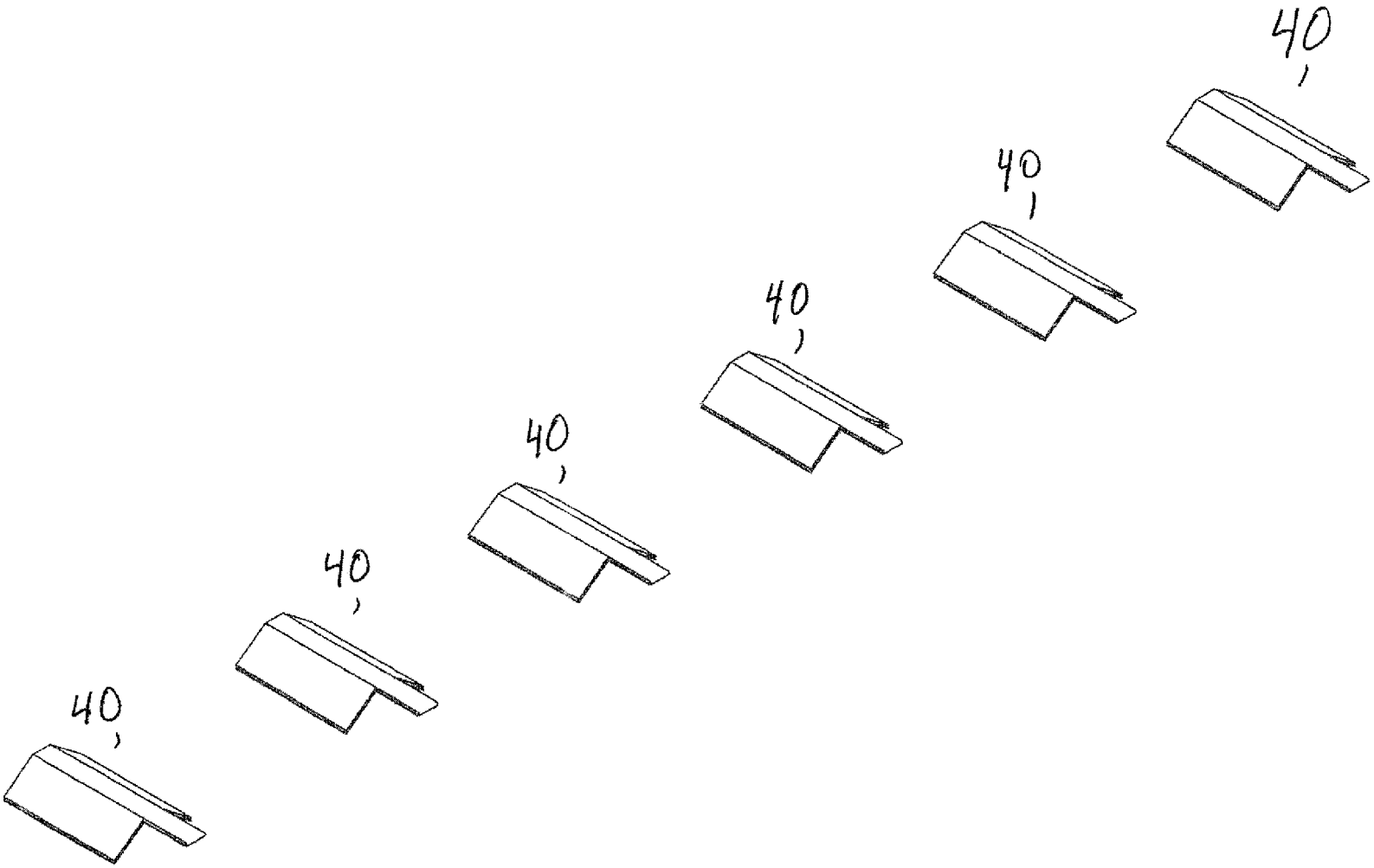
FIG. 35 is an isometric view of the ridge anchor plate of a preferred embodiment of the apparatus of the present invention used in both structural and nonstructural applications (shown with R-panel profile)
Figure 36:
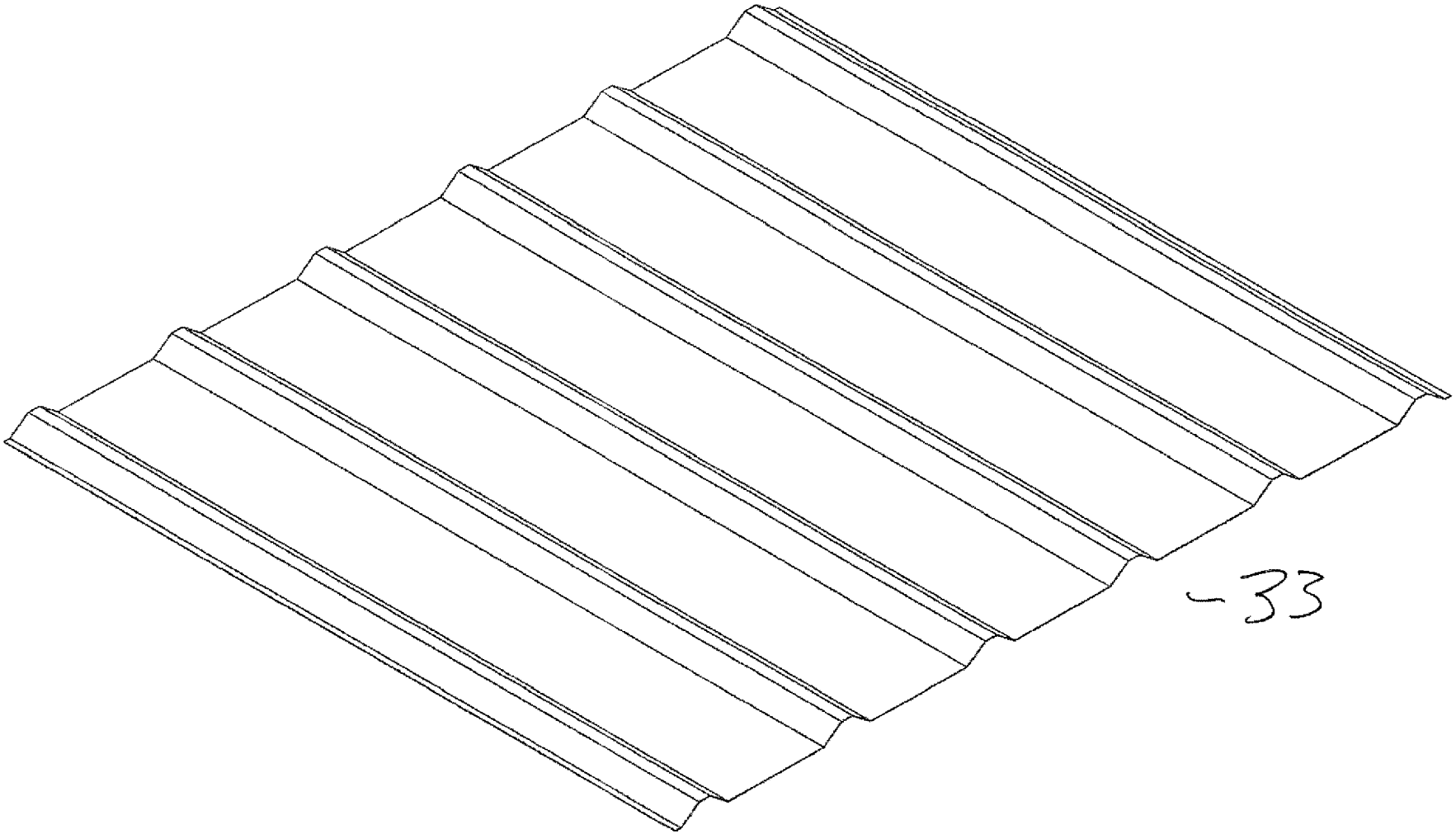
FIG. 36 is a partial isometric view of the R-panel of a preferred embodiment of the apparatus of the present invention (R-panel profile is one of many corrugated panel profiles available in the industry of which any corrugated profile can be used with the present invention)
Figure 37:
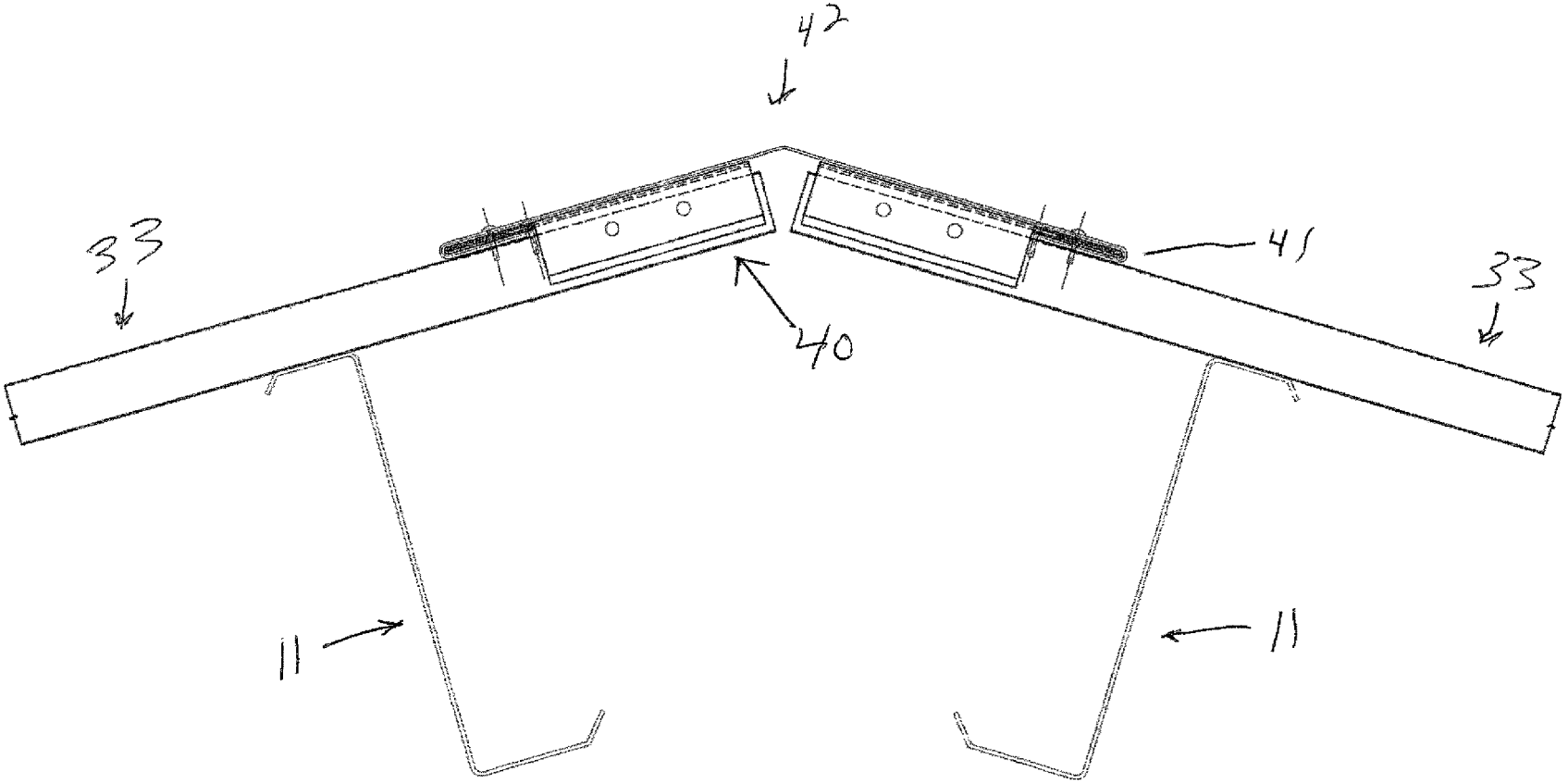
FIG. 37 is a sectional view of a preferred embodiment of the apparatus of the present invention showing ridge anchor body, ridge sliding anchor, and R-panel (bottom cleat and top cleat not shown) installed over a Z-purlin system (structural application)
Figure 38:
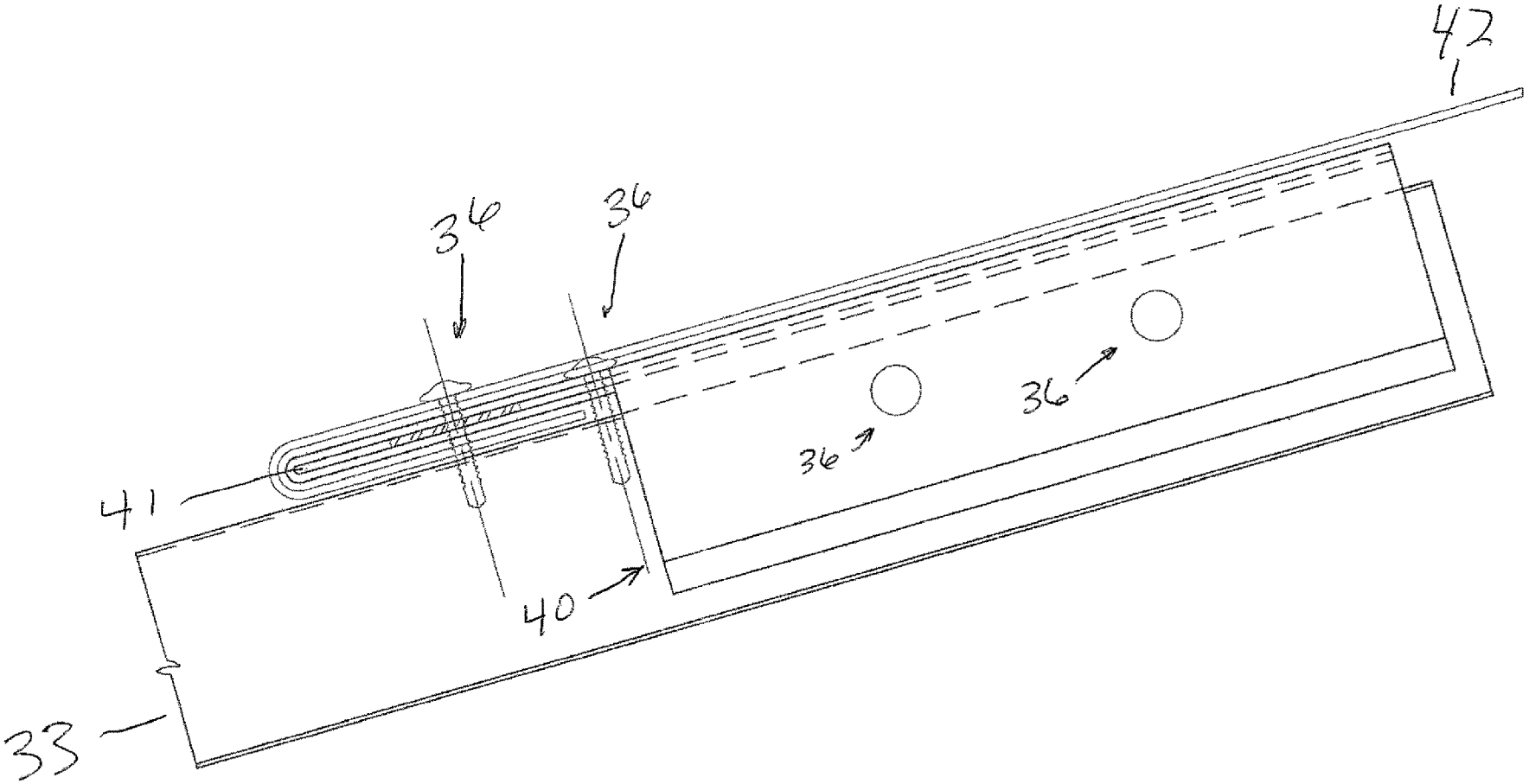
FIG. 38 is a close-up sectional view of a preferred embodiment of the apparatus of the present invention showing the ridge anchor body, ridge sliding anchor, ridge cap, screws and R-panel (bottom and top cleat not shown)
Figure 42:
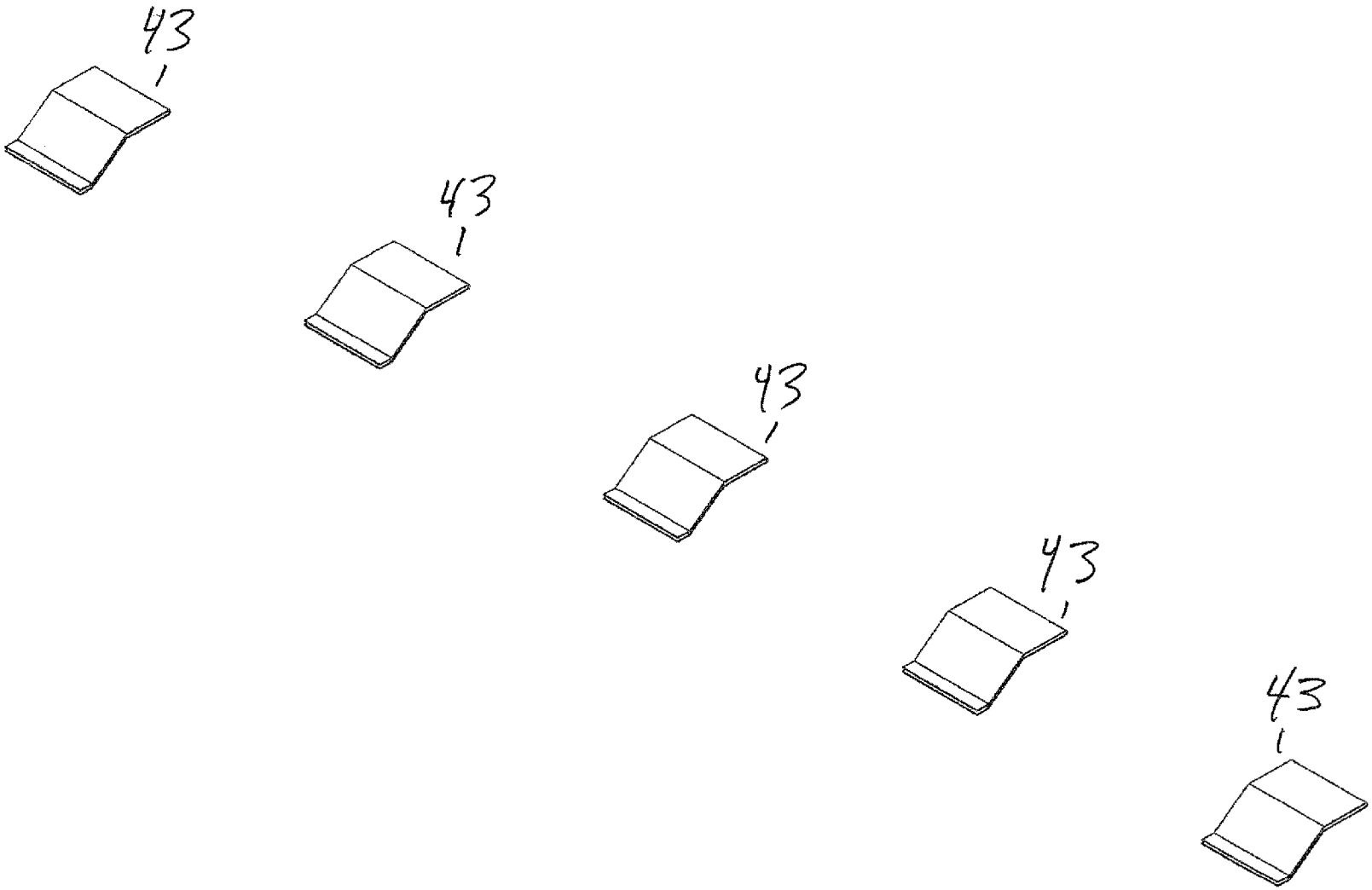
FIG. 42 is an isometric view of the rake anchor plate of a preferred embodiment of the apparatus of the present invention used in both structural and nonstructural applications (shown with R-panel profile)
Figure 43:
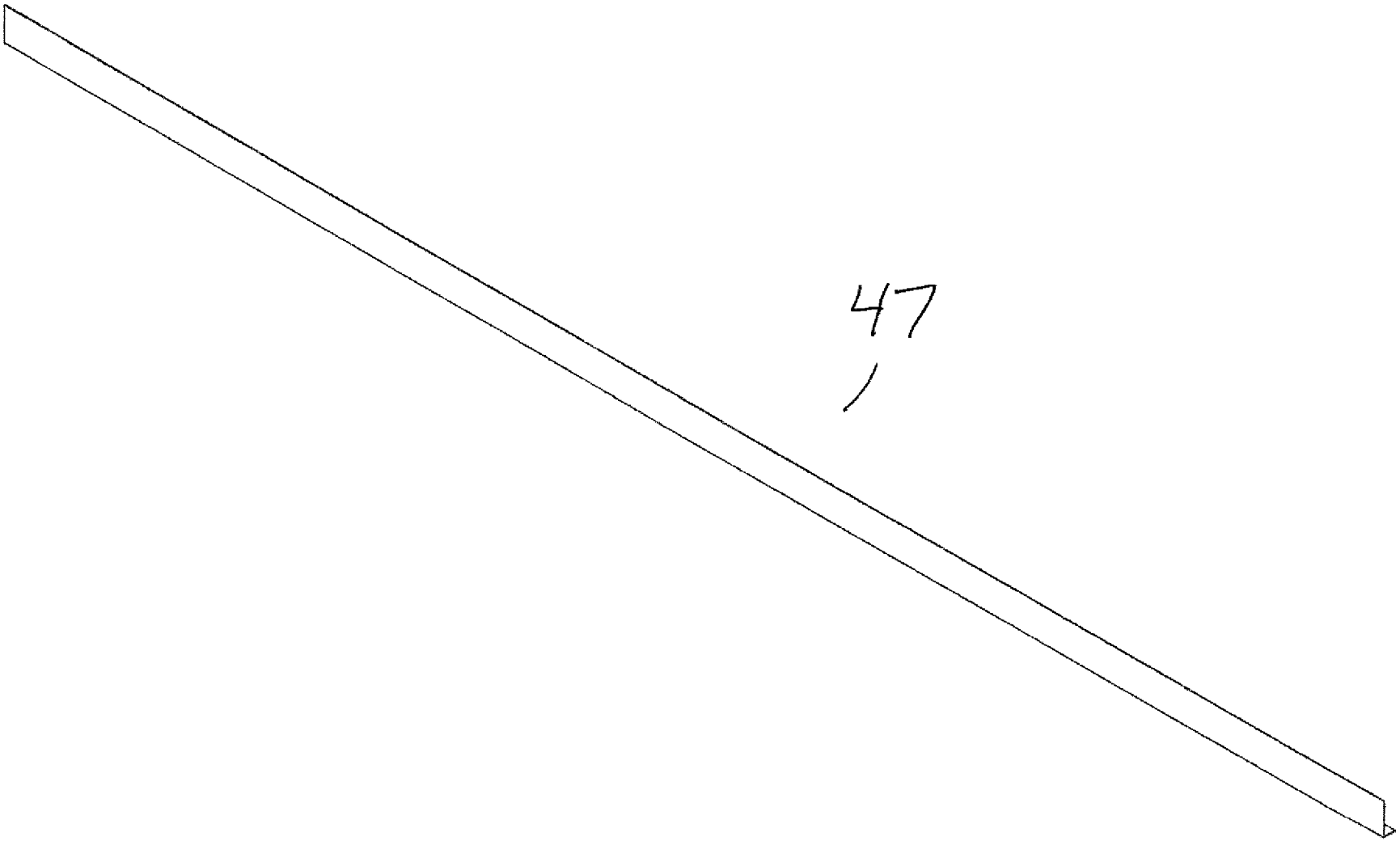
FIG. 43 is an isometric view of the rake drip edge of a preferred embodiment of the apparatus of the present invention used in both structural and nonstructural applications.
Figure 44:
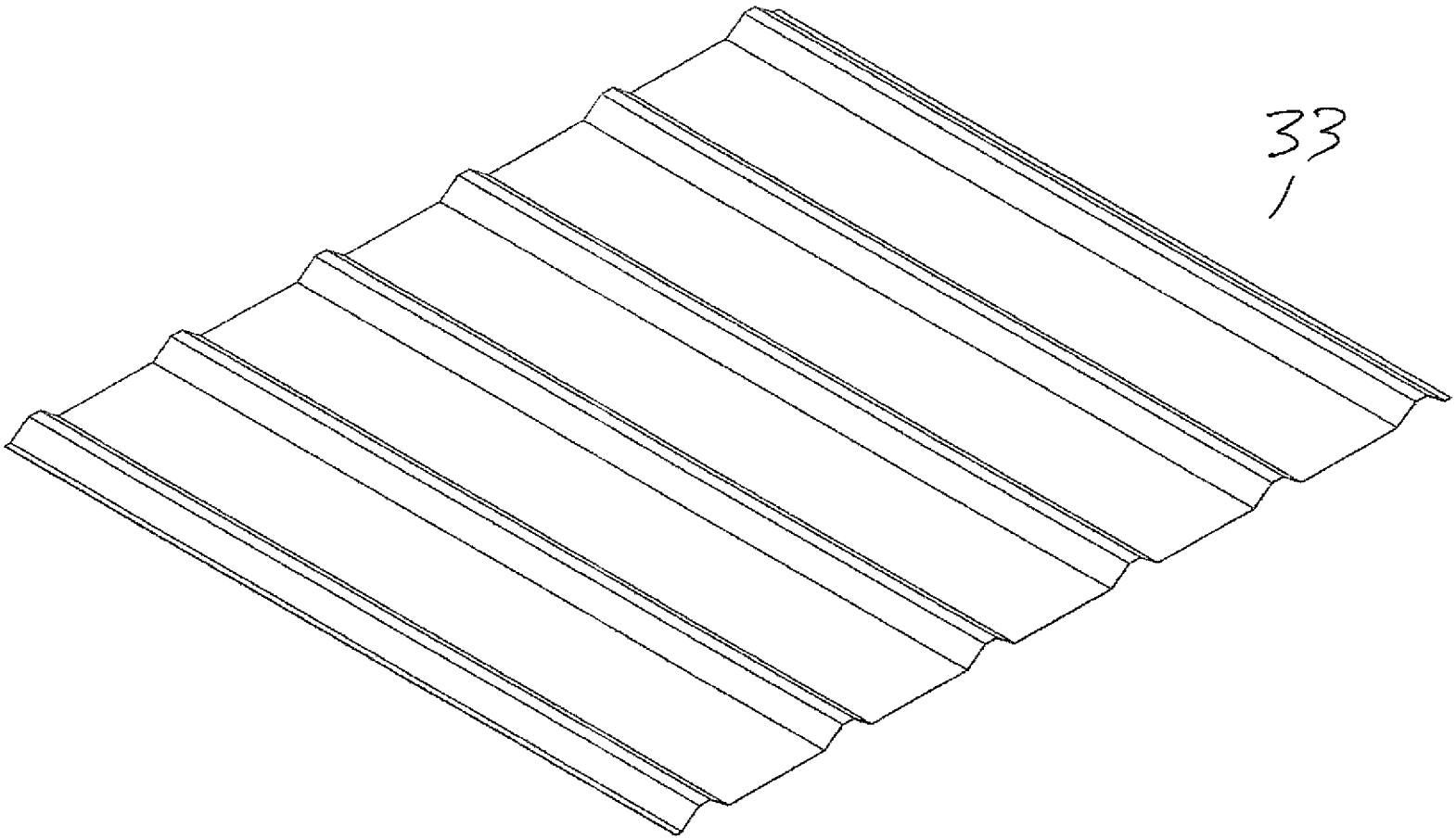
FIG. 44 is a partial isometric view of the R-panel of a preferred embodiment of the apparatus of the present invention (R-panel profile is one of many corrugated panel profiles available in the industry of which any corrugated profile can be used with the present invention)

The flashing clips of the present invention allow the roof system to thermally move in any direction without impacting the movement of the flashing (FIG. 37, 38, 45). The flashing and roof move independently of one another (FIG. 37, #42 & #33). The attachment method of the flashing and the flashing clip is also based on shearing instead of typical pullout (FIG. 38, #36). The flashing clips (FIGS. 35, 42) are mounted on the ribs of the roof panels (FIGS. 36, 44).

Figure 34:
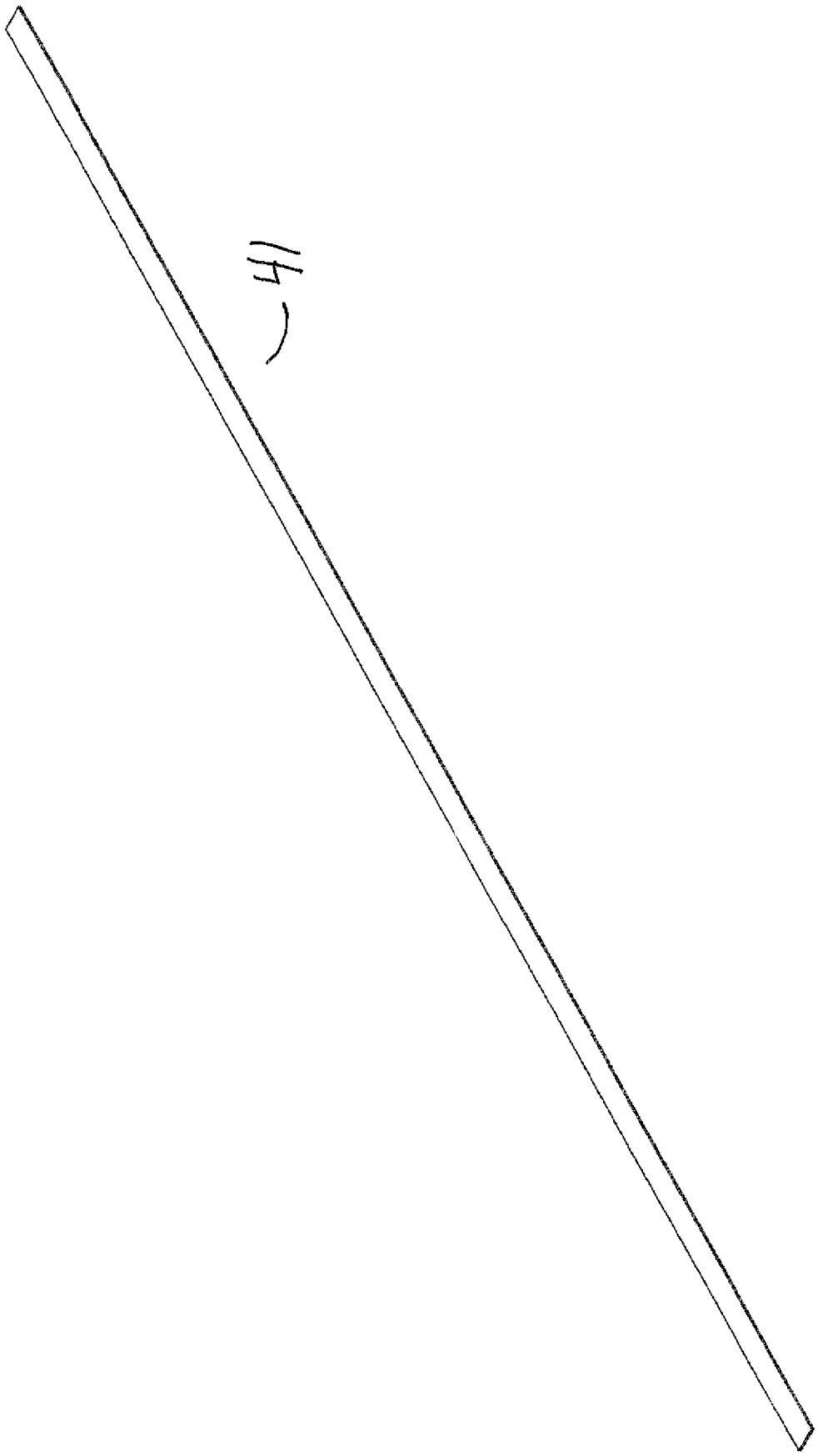
FIG. 34 is an isometric view of the ridge sliding anchor of a preferred embodiment of the apparatus of the present invention used in both structural and nonstructural applications.
Figure 45:
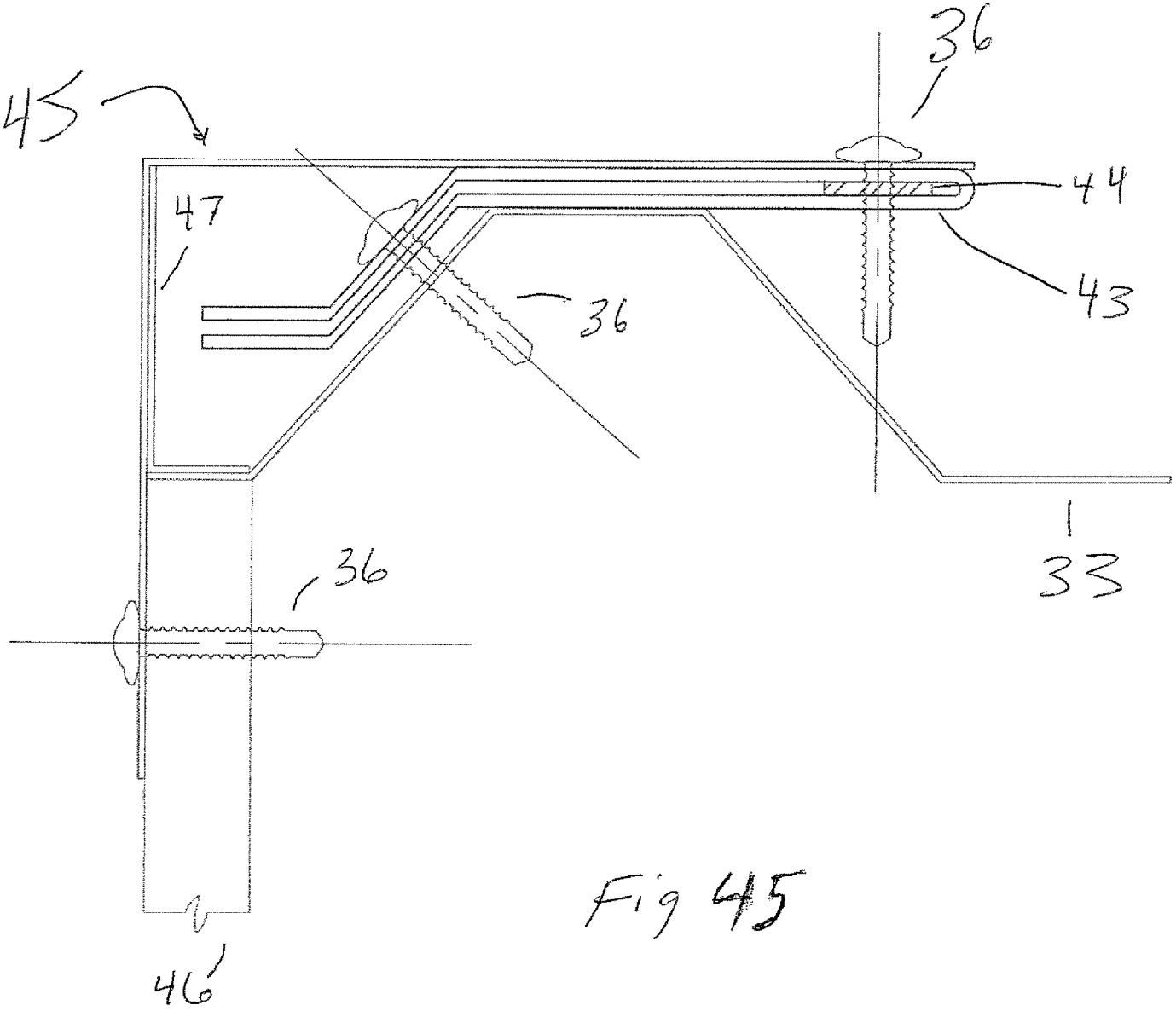
FIG. 45 is a close-up sectional view of a preferred embodiment of the apparatus of the present invention showing the rake anchor body, rake sliding anchor, rake flashing, rake drip edge, screws and R-panel (bottom and top cleat not shown).

The flashing clips have a sliding anchor (FIG. 34, 41). When the flashing clip is installed on the rib of the roof panel and the flashing wrapped around/fastened to the sliding anchor, the roof can move while the flashing stays stationary (FIG. 38, #33, #42 & FIG. 45, #33, #45). The fastening to the sliding anchor is based on shearing forces so the flashing can be wind rated at the same level as the roof (FIG. 37, 38, 45, #36).

The present invention includes a building including a roof of the present invention and walls of the present invention.

The following is a list of parts and materials suitable for use in the present invention:

PARTS LIST:

| PART NUMBER | DESCRIPTION |
|---|---|
| 10 | roof and clip apparatus |
| 11 | Z purlin |
| 12 | barrier/radiant barrier |
| 13 | anchor plate |
| 14 | sliding anchor |
| 15 | web |
| 16 | flange |
| 17 | flange |
| 18 | inner section |
| 19 | outer section |
| 20 | bend |
| 21 | space |
| 22 | foot/base |
| 23 | inclined portion/upwardly projecting portion |
| 24 | vertical anchor plate screw/fastener |
| 25 | horizontal anchor plate screw/fastener |
| 26 | steel web joist/joist |
| 27 | anchor plate |
| 28 | inner section |
| 29 | outer section |
| 30 | bend/fold |
| 31 | plate opening |
| 32 | fold |
| 33 | R-panel roof panel |
| 34 | R-panel roof panel |
| 35 | R-panel roof panel |

-continued

PARTS LIST:

| PART NUMBER | DESCRIPTION |
|---|---|
| 36 | screw/fastener |
| 37 | bottom cleat |
| 38 | top cleat |
| 39 | purlin bearing leg |
| 40 | ridge anchor plate |
| 41 | ridge sliding anchor |
| 42 | ridge cap |
| 43 | rake anchor plate |
| 44 | rake sliding anchor |
| 45 | rake flashing |
| 46 | wall panel |
| 47 | rake drip edge |
| 48 | wood rafter |
| 49 | plywood deck |
| 50 | Tandem ™ Standing Seam panel |
| 51 | web joist insert |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A metal roof construction, comprising:

a) a roof frame that includes multiple purlins;

b) an anchor plate having a plurality of spaced apart anchor plate openings;

c) a sliding anchor that connects to said anchor plate, each sliding anchor having multiple spaced apart upwardly projecting portions that each extend from said anchor plate upwardly through a said anchor plate opening;

d) wherein each said anchor plate opening is larger in all directions than a said upwardly projecting portion so that each upwardly projecting portion can move relative to said anchor plate in any direction;

e) said anchor plate having one or more flanges that extend downwardly;

f) multiple roof panels positioned above said anchor plate and sliding anchor;

g) bottom cleats positioned below said roof panels and above said anchor plate;

h) wherein each bottom cleat extends through a said upwardly projecting portion opening and above a said anchor plate; and i) one or more fasteners that secure each said roof panels to an assembly of purlin, anchor plate, sliding anchor and bottom cleat.

2. The metal roof construction of claim 1 wherein said sliding anchor has a lower most section that occupies said anchor below said anchor plate openings and wherein said upwardly projecting portions each extend upwardly from said lower most section.

3. The metal roof construction of claim 2 wherein multiple said upwardly extending portions are attached to the lower most section of said sliding anchor.

4. The metal roof construction of claim 2 wherein all of said upwardly extending portions move together with said sliding anchor.

5. The metal roof construction of claim 1 wherein one or more of said roof panels attach to a said upwardly extending portion.

6. The metal roof construction of claim 5 wherein each said roof panel attaches to multiple of said upwardly extending portions.

7. A metal roof construction, comprising:

a) a roof frame that includes multiple purlins;

b) an anchor member with a longitudinally extending anchor member space;

c) said anchor member having a plurality of spaced apart anchor member openings above said space;

d) a sliding anchor member having a lower section positioned in said anchor member longitudinally extending space, each sliding anchor member having multiple spaced apart upwardly projecting portions;

e) wherein each upwardly projecting portion extends from said anchor member longitudinally extending space upwardly through a said anchor member opening;

f) wherein each anchor member opening is larger than a said upwardly extending portion so that the upwardly extending portion can adjustably slide in any direction with said sliding anchor member relative to said anchor member opening;

g) each said anchor member having one or more flanges that extend downwardly;

h) multiple bottom cleats that each extend through a said upwardly extending portion of a said sliding anchor at a position that is above said anchor member; and i) multiple roof panels that are attached to an assembly of said anchor members, said sliding anchor members, and said multiple purlins.

8. The metal roof construction of claim 7 further comprising a plurality of top cleats above said roof panels and that are connected to both said roof panels and said bottom cleats.

9. The metal roof construction of claim 7 wherein said sliding anchor member has a lower most section that occupies said anchor plate space and wherein said upwardly extending portion extends upwardly from said lower most section.

10. The metal roof construction of claim 7 wherein one or more fasteners each fasten said anchor plate member to one of said multiple purlins.

11. The metal roof construction of claim 7 wherein each roof panel is an R type roof panel.

* * * * *